US008623140B2

(12) United States Patent
Yapel et al.

(10) Patent No.: US 8,623,140 B2
(45) Date of Patent: Jan. 7, 2014

(54) SYSTEM AND METHOD FOR MAKING A FILM HAVING A MATTE FINISH

(75) Inventors: Robert A. Yapel, Oakdale, MN (US); Francis M. Aguirre, St. Francis, MN (US); John P. Baetzold, North St. Paul, MN (US); Olester Benson, Jr., Woodbury, MN (US); Andrew J. Henderson, Eagan, MN (US); Mitchell A. F. Johnson, Maplewood, MN (US); Leslie A. Kreilich, St. Paul, MN (US); Steven J. McMan, Stillwater, MN (US); David L. Phillips, White Bear Lake, MN (US); Bruce D. Shalles, River Falls, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 1411 days.

(21) Appl. No.: 11/782,772

(22) Filed: Jul. 25, 2007

(65) Prior Publication Data

US 2009/0029054 A1 Jan. 29, 2009

(51) Int. Cl.
*B05C 11/00* (2006.01)
*B05C 3/00* (2006.01)

(52) U.S. Cl.
USPC ..... 118/600; 118/410; 118/419; 118/420; 118/58; 118/67; 118/68; 118/69

(58) Field of Classification Search
USPC ..... 118/600, 410, 325, 419, 420, 110, 114, 118/117, 58, 66–69; 427/359; 977/773; 156/244.11, 244.24
See application file for complete search history.

(56) References Cited

U.S. PATENT DOCUMENTS

| | | | | |
|---|---|---|---|---|
| 3,896,248 | A | 7/1975 | Scarpa | |
| 3,959,546 | A | 5/1976 | Hill | |
| 4,068,616 | A * | 1/1978 | Baum et al. | 118/665 |
| 4,179,541 | A | 12/1979 | Miyama et al. | |
| 4,954,297 | A | 9/1990 | Beery et al. | |
| 5,565,260 | A | 10/1996 | Hawk | |
| 5,633,041 | A | 5/1997 | Arrington | |

(Continued)

FOREIGN PATENT DOCUMENTS

| | | |
|---|---|---|
| GB | 1187452 | 4/1970 |
| JP | S59-196775 | 11/1984 |
| JP | 2001-281407 | 10/2001 |

*Primary Examiner* — Yewebdar Tadesse
(74) *Attorney, Agent, or Firm* — Julie Lapos-Kuchar; James A. Baker; Daniel R. Pastirik

(57) ABSTRACT

A system and a method for providing a film having a matte finish. The system includes means for providing a coated substrate, the coated substrate comprising a first coatable material applied to a substrate, the coatable material forming a first major surface of the coated substrate; means for changing the viscosity of the first coatable material from a first viscosity to a second viscosity; a face-side roller having an outer surface positioned to contact the first major surface of the coated substrate to impart a matte finish thereon; and optionally, means for hardening the first coatable material. The method of the invention includes the steps of (1) providing a coated substrate comprising a coatable material disposed on a substrate, the coatable material providing a first major surface of the coated substrate; (2) changing the viscosity of the coatable material from the initial viscosity to a second viscosity; (3) contacting the first major surface of the coated substrate with at least one face-side roller to impart a matte finish; and (4) optionally, hardening the coatable material to provide the film.

41 Claims, 9 Drawing Sheets

(56) References Cited

U.S. PATENT DOCUMENTS

| | | | | |
|---|---|---|---|---|
| 5,686,142 | A | 11/1997 | Wallack et al. | |
| 5,686,186 | A | 11/1997 | Enlow et al. | |
| 5,853,801 | A * | 12/1998 | Suga et al. | 427/164 |
| 5,928,726 | A | 7/1999 | Butler et al. | |
| 6,025,024 | A | 2/2000 | Heindrichs et al. | |
| 6,378,154 | B1 | 4/2002 | Corrado et al. | |
| 6,525,112 | B1 | 2/2003 | Bammel | |
| 6,737,113 | B2 | 5/2004 | Leonard et al. | |
| 6,855,371 | B2 | 2/2005 | Gier et al. | |
| 6,878,408 | B2 | 4/2005 | Leonard et al. | |
| 6,899,922 | B2 | 5/2005 | Leonard et al. | |
| 6,969,540 | B2 | 11/2005 | Seaver et al. | |
| 7,173,778 | B2 | 2/2007 | Jing et al. | |
| 2004/0142110 | A1 | 7/2004 | Branca et al. | |
| 2005/0282934 | A1 | 12/2005 | Brinkmann et al. | |
| 2007/0231479 | A1 * | 10/2007 | Ogawa et al. | 427/162 |

* cited by examiner

SYSTEM AND METHOD FOR MAKING A FILM HAVING A MATTE FINISH

The present invention relates to systems and methods for providing a film having a matte finish.

BACKGROUND

Patterned finishes on coated films are known and can be provided via the interaction between a carrier layer or substrate and a material disposed on the substrate (e.g., a coatable material), the patterned finish being formed upon removal of the carrier layer. Drying techniques have been employed to create a patterned finish using a roll having a heated surface that includes a pattern of discontinuities which, when contacting a coatable material such as a curable resin or the like, create a pattern within the surface of the material while drying it at the same time. The resulting article retains the pattern from the roller and the coatable material is left partially or fully dried, hardened and/or cured.

Embossing imparts a texture to a film using a patterned roller and is used most often in applications in which the durability of the film is not a concern. Embossing is not normally used in and does not address the need for matte hard coats for protective display applications, for example. Patterned films have also been made by first coating a flowable and coatable material (e.g., a resin) onto the patterned surface of a tool, the pattern being provided as cavities that receive the coatable material so that, once hardened or partially cured, a durable patterned film is provided. However, the creation and maintenance of patterned tooling is difficult and expensive.

Films with matte finishes have been created by the addition of beads or particles to a coatable material such as a resin or a polymeric precursor and applying the material to a backing. When hardened or cured, the material forms a film in which the particles or beads provide physical irregularities at the surface, resulting in a matte finish. Particles or beads must be blended homogenously in the coatable material, and further processing of the material (e.g., pumping, coating, filtering and drying) is required to provide a film with a suitable finish. Dispersing beads or particles uniformly in a coatable material and maintaining the homogeneity of the resulting blend is difficult. Point defects and streaking are often seen in the finished articles, and merely pumping the coatable material can require special equipment to minimize damage to the particles. Particle filled coatable materials can be prone to the formation of patterns, such as mottle, caused by the drying process. The resulting articles typically have undesirable optical properties. Films intended for use in optical applications must be formulated to match the index of refraction of the particles with that of the coatable material which, in turn, requires control of the particle size distribution. Undesired scattering of light within the finished film can be due to a mismatch of the index of refraction of the particles relative to the bulk of the coatable material.

It is desirable to provide novel systems and methods for the manufacture of films having matte finishes.

SUMMARY

In one aspect, the present invention provides a system for providing a film having a matte finish, the system comprising:

Means for providing a coated substrate, the coated substrate comprising a first coatable material applied to a substrate, the coatable material forming a first major surface of the coated substrate;

Means for changing the viscosity of the first coatable material from a first viscosity to a second viscosity;

A face-side roller having an outer surface positioned to contact the first major surface of the coated substrate to impart a matte finish thereon; and Optionally, means for hardening the first coatable material.

In another aspect, the invention provides a method of making a film having a matte finish, the method comprising:

Providing a coated substrate comprising a coatable material disposed on a substrate, the coatable material providing a first major surface of the coated substrate;

Changing the viscosity of the coatable material from the initial viscosity to a second viscosity;

Contacting the first major surface of the coated substrate with at least one face-side roller to impart a matte finish; and Optionally, hardening the coatable material to provide the film.

In still another aspect, the present invention provides a system for providing a film having a matte finish, the system comprising:

A first station for coating a substrate with a coatable material having a initial viscosity, the coatable material and the substrate forming a coated substrate in which the coatable material forms a first major surface of the coated substrate;

A second station for changing in the viscosity of the coatable material from the initial viscosity to a second viscosity;

A third station comprising at least one face-side roller having a surface positioned to contact the first major surface of the coated substrate to impart a matte finish thereon; and A fourth station for hardening the coatable material.

Various terms used herein will be understood to be defined according to their ordinary meaning, as known by those skilled in the art. However, the following terms will be understood to have the meanings set forth herein.

The term "polymer" will be understood to include polymers, copolymers (e.g., polymers formed using two or more different monomers), oligomers and combinations thereof. Both block and random copolymers are included, unless indicated otherwise.

"Polymeric material" will be understood to include polymers, as defined above, and other organic or inorganic additives, such as, for example, antioxidants, stabilizers, antiozonants, plasticizers, dyes, UV absorbers, hindered amine light stabilizers (HALS), and pigments.

"Coatable material" means a non-solid (e.g., liquid or gel-like) material that is capable of being coated onto a surface.

"Face-side roller" means a roller or other instrument(s) that includes a surface that directly contacts the surface of a coated substrate to impart a matte finish to the surface of the coatable material. Although the described embodiments utilize an actual roller, a face-side roller may comprise any of a variety of configurations including without limitation a belt mounted on and driven by one or more drive rollers.

"Optically clear" refers to the transparency of a material, typically permitting a high level (e.g., >99% when corrected for reflection losses) of light transmission and low haze (e.g., <1%).

"Matte finish" means a rough or granular surface finish or texture that is lacking a high luster or gloss. The matte finish may be smooth to the touch but is generally free from significant shine or highlights.

The term "phr" refers to a unit of parts by weight of a component in a coating composition having 100 parts by weight of polymeric material.

Those skilled in the art will further appreciate the embodiments of the invention upon consideration of the remainder of the disclosure including the Detailed Description with the accompanying drawings and the appended claims.

BRIEF DESCRIPTION OF THE DRAWINGS

In describing embodiments of the invention, reference is made to the various Figures in which reference numerals indicate described features of the embodiments and like reference numerals indicate like structures, wherein.

DETAILED DESCRIPTION

The present invention provides a system and a process for the manufacture of films having a matte finish. In the process for the manufacture of matte-finish films, a coated substrate is provided, the coated substrate comprising a coatable material on a substrate or backing. In some embodiments, the coated substrate is prepared in advance and the previously prepared coated substrate is placed into the manufacturing process 'as is.' In some embodiments, the coated substrate is manufactured as part of the overall manufacturing process in which a coatable material is applied to (e.g., coated on) a substrate to provide the coated substrate. Coatable material is carried on the substrate and is treated to change the viscosity of the coatable material from a first or initial viscosity to a second viscosity. In some embodiments, the first viscosity is lower than the second viscosity so that the coatable material is changed by being thickened or partially cured. In some embodiments, the coatable material may have an initial viscosity that is higher than the second viscosity so that changing the viscosity of the coatable material may require at least some softening of the coatable material. Once the viscosity of the coatable material is at a second viscosity, the material is then subjected to face-side pressure to impart a matte finish thereon. With its matte finish, the coatable material may optionally be further hardened, cured or solidified and the resulting film may be conveyed to another processing station such as a cutting station, or to a wind-up roll, for example. Coatable materials useful in the process of the invention may generally be prepared without the addition of beads, particles, or other matting agents. In addition, expensive tooling is not required to impart a matte finish.

Figure 1:
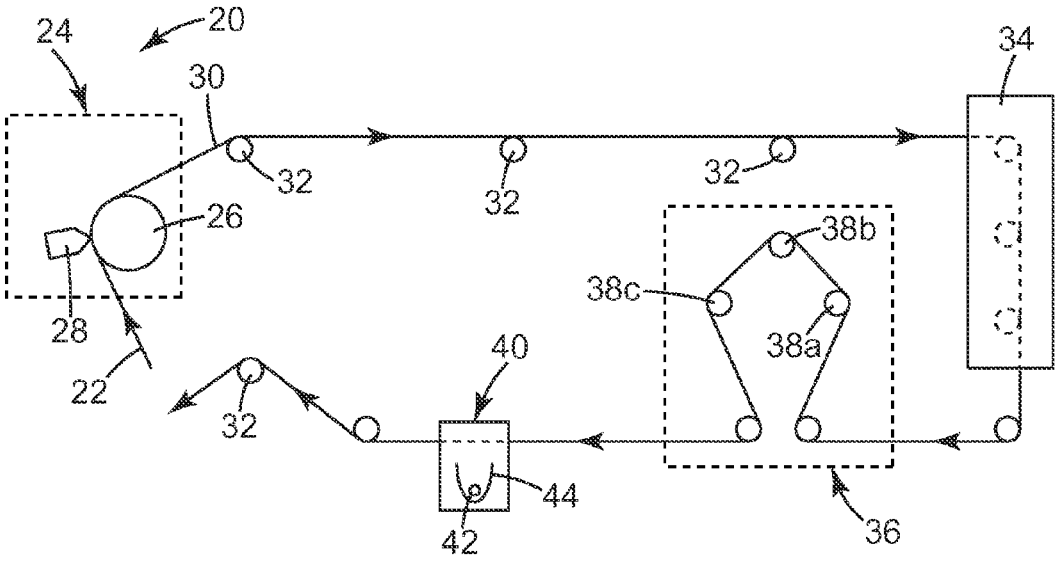
FIG. 1 is a schematic view of a system for providing a matte finish on a film according an embodiment of the present invention.

Referring now to the various Figures, embodiments of the invention are shown and will now be described. FIG. 1 is a schematic view of one embodiment of a coating system 20 capable of carrying out a manufacturing process according to the present invention. Means for providing a coated substrate encompass a coating process within the system 20. In the depicted embodiment, a coated substrate is manufactured as part of the overall manufacturing process within system 20. Uncoated substrate 22 is fed into the system 20 from a source (not shown) such as an extruder, a supply roll or the like. Substrate 22 is conveyed to a first station 24 in an uncoated state, though it may be primed on at least one surface thereof, and travels to the first station 24 where it is picked up by back-up roll 26 so that a major surface of the substrate 22 is in contact with the back-up roll and the idler rollers 32 to advance the substrate 22 through the system 20. The other major surface of the substrate 22 receives coatable material to thereby provide a coated substrate 30.

In embodiments of the invention, means for providing a coated substrate may include a source of a pre-coated substrate comprising a polymer coating on a major surface of a backing. The pre-coated substrate may be fed from a feed roll (not shown) directly into the system 20 without requiring an additional coating step via first station 24. In such an embodiment, the pre-coated substrate may be directed into optional second station, third station or the like, as described hereinbelow.

Any of a variety of materials may be suitable for use as substrate 22 including flexible materials such as, for example, woven materials, knitted materials, films (e.g., polymeric films), nonwovens, metal sheet, metal foils, glass and the like. In some embodiments where the final film product is intended for use in optical applications such as in an optical display, the substrate material will be chosen based in part on the desired optical and mechanical properties for the intended use. Mechanical properties can include flexibility, dimensional stability and impact resistance. In some embodiments, an optically clear material (e.g., transparent) may be desired. Examples of suitable optically clear materials include optically clear polyester film, triacetate (TAC) film, polyethylene naphthalate, polycarbonate, cellulose acetate, poly(methyl methacrylate), polyolefins such as biaxially oriented polypropylene (BOPP) and simultaneously biaxially-oriented polypropylene (S-BOPP). The substrate 22 may comprise or consist of polyamides, polyimides, phenolic resins, polystyrene, styrene-acrylonitrile copolymers, epoxies, and the like.

The thickness of the substrate 22 can vary and will typically depend on the intended use of the final article. In some embodiments, substrate thicknesses are less than about 0.5 mm and typically between about 0.02 and about 0.2 mm. Polymeric substrate materials can be formed using conventional filmmaking techniques (e.g., extrusion and optional uniaxial or biaxial orientation of the extruded film). The substrate 22 can be treated to improve adhesion between the substrate and the layer of coatable material. Exemplary of such treatments include chemical treatment, corona treatment (e.g., air or nitrogen corona), plasma, flame, or actinic radiation. Interlayer adhesion can also be improved with the use of an optional tie layer or primer applied to the substrate 22 and/or the coatable material.

Where the finished articles are intended to be used in display panels, the substrate 22 is typically light transmissive, meaning light can be transmitted through the substrate 22 so that the display can be viewed. Suitable light transmissive optical films include without limitation multilayer optical films, microstructured films such as retroreflective sheeting and brightness enhancing films (e.g. reflective or absorbing), polarizing films, diffusive films, as well as (e.g. biaxial) retarder films and compensator films such as described in U.S. Patent Application Publication No. 2004/0184150 A1, filed Jan. 29, 2004, the entire disclosure of which is incorporated herein by reference.

As described in U.S. Patent Application Publication No. 2003/0217806 A1, the entire disclosure of which is incorporated herein by reference, multilayer optical films are films that provide desirable transmission and/or reflection properties at least partially by an arrangement of microlayers having differing refractive indices. Each of the microlayers are sufficiently thin so that light reflected at a plurality of such interfaces undergoes constructive or destructive interference to give the film its reflective or transmissive properties. For optical films designed to reflect ultraviolet, visible, or near-infrared wavelengths, each microlayer generally has an optical thickness (i.e., a physical thickness multiplied by its refractive index) of less than about 1 micron. Thicker layers can also be included such as skin layers at the outer surfaces of the film, or protective boundary layers disposed within the film that separate packets of microlayers. Multilayer optical film bodies can also comprise one or more thick adhesive layers to bond two or more sheets of multilayer optical film in a laminate.

The reflective and transmissive properties of multilayer optical film are functions of the refractive indices of the respective microlayers. Each microlayer can be characterized at least at localized positions in the film by in-plane refractive indices $n_x$, $n_y$ and a refractive index $n_z$ associated with a thickness axis of the film. These indices represent the refractive index of the subject material for light polarized along mutually orthogonal x-, y- and z-axes. In practice, the refractive indices are controlled by judicious materials selection and processing conditions. Suitable films can be made by the co-extrusion of multiple layers, typically tens or hundreds of layers, of two alternating polymers (polymers A, B), followed by optionally passing the multilayer extrudate through one or more multiplication die, and then stretching or otherwise orienting the extrudate to form a final film. The resulting film is composed of multiple (e.g., tens or hundreds) microlayers whose thicknesses and refractive indices are tailored to provide one or more reflection bands in desired region(s) of the spectrum, such as in the visible or near infrared.

Exemplary materials that can be used in the fabrication of polymeric multilayer optical film can be found in PCT Publication WO 99/36248 (Neavin et al.), the entire disclosure of which is incorporated herein by reference. Desirably, at least one of the materials is a polymer with a stress optical coefficient having a large absolute value. In other words, the polymer preferably develops a large birefringence (at least about 0.05, more preferably at least about 0.1 or even 0.2) when stretched. Depending on the application of the multilayer film, the birefringence can be developed between two orthogonal directions in the plane of the film, between one or more in-plane directions and the direction perpendicular to the film plane, or a combination of these. In special cases where isotropic refractive indices between unstretched polymer layers are widely separated, the preference for large birefringence in at least one of the polymers can be relaxed, although birefringence is still often desirable. Such special cases may arise in the selection of polymers for mirror films and for polarizer films formed using a biaxial process, which draws the film in two orthogonal in-plane directions. Further, the polymer desirably is capable of maintaining birefringence after stretching, so that the desired optical properties are imparted to the finished film. A second polymer can be chosen for other layers of the multilayer film so that in the finished film the refractive index of the second polymer, in at least one direction, differs significantly from the index of refraction of the first polymer in the same direction. For convenience, the films can be fabricated using only two distinct polymer materials, and interleaving those materials during the extrusion process to produce alternating layers A, B, A, B, etc. Interleaving only two distinct polymer materials is not required, however. Instead, each layer of a multilayer optical film can be composed of a unique material or blend not found elsewhere in the film. Preferably, polymers being coextruded have the same or similar melt temperatures.

Exemplary two-polymer combinations that provide both adequate refractive index differences and adequate interlayer adhesion include: (1) for polarizing multilayer optical film made using a process with predominantly uniaxial stretching, PEN/coPEN, PET/coPET, PEN/sPS, PET/sPS, PEN/Eastar™ polyester and PET/Eastar™ polyester where "PEN" refers to polyethylene naphthalate, "coPEN" refers to a copolymer or blend based upon naphthalene dicarboxylic acid, "PET" refers to polyethylene terephthalate, "coPET" refers to a copolymer or blend based upon terephthalic acid, "sPS" refers to syndiotactic polystyrene and its derivatives, and Eastar™ is a trade designation for a polyester or copolyester (believed to comprise cyclohexanedimethylene diol units and terephthalate units) commercially available from Eastman Chemical Co.; (2) for polarizing multilayer optical film made by manipulating the process conditions of a biaxial stretching process, PEN/coPEN, PEN/PET, PEN/PBT, PEN/PETG and PEN/PETcoPBT, where "PBT" refers to polybutylene terephthalate, "PETG" refers to a copolymer of PET employing a second glycol (usually cyclohexanedimethanol), and "PETcoPBT" refers to a copolyester of terephthalic acid or an ester thereof with a mixture of ethylene glycol and 1,4-butanediol; (3) for mirror films (including colored mirror films), PEN/PMMA, coPEN/PMMA, PET/PMMA, PEN/Ecdel™ thermoplastic polyester, PET/Ecdel™ thermoplastic polyester, PEN/sPS, PET/sPS, PEN/coPET, PEN/PETG, and PEN/THV™ fluoropolymers, where "PMMA" refers to polymethyl methacrylate, Ecdel™ is a trade designation for a thermoplastic polyester or copolyester (believed to comprise cyclohexanedicarboxylate units, polytetramethylene ether glycol units, and cyclohexanedimethanol units) commercially available from Eastman Chemical Co., and THV™ is a trade designation for a fluoropolymer commercially available from 3M Company of St. Paul, Minn.

Further details of suitable multilayer optical films and related constructions can be found in U.S. Pat. No. 5,882,774 (Jonza et al.), and PCT Publications WO 95/17303 (Ouderkirk et al.) and WO 99/39224 (Ouderkirk et al.), the entire disclosures of which are incorporated herein by reference. Polymeric multilayer optical films and film bodies can comprise additional layers and coatings selected for their optical, mechanical, and/or chemical properties. The polymeric films and film bodies can also comprise inorganic layers, such as metal or metal oxide coatings or layers.

In other embodiments, the substrate 22 may comprise or consist of any of a variety of non-polymeric materials, such as glass, metal sheeting, paper, knitted materials, fabrics, or the like.

It will be appreciated that the first station 24 provides a means for applying a coatable material to a substrate 22 to form a coated substrate 30 in which the coatable material has a first major surface in contact with the substrate and a second major surface opposite the first major surface. In the embodiment shown in FIG. 1, substrate 22 is provided as a continuous or uncut material. In other embodiments, the substrate may be provided in a discontinuous form or in individual pieces (e.g., pre-cut or pre-made to suit a specific application).

While a first station is provided with die coating apparatus such as an extrusion die in relation to the embodiment of FIG. 1, other coating methods are contemplated and are within the skill of those practicing in the field. It will be understood that the use of die coating is merely exemplary, and other methods of coating may be equally suitable such as slide coating, curtain coating, immersion coating, roll coating, gravure coating, fluid-bearing coating, spray coating and the like. Die coaters of the type generally described in co-assigned U.S. Pat. No. 5,639,305, the disclosure of which is incorporated herein by reference thereto, are suitable for the production of matte-finish films according to the present invention. Additionally, pick and place devices, ink jet and other spray coating technologies may be employed in coating the substrate according to the present invention. Suitable pick and place devices are described in, for example, U.S. Pat. Nos. 6,737,113; 6,878,408; 6,899,922; and 6,969,540 the disclosures of which are incorporated in their entireties herein by reference thereto.

As dispensed onto the substrate 22, the coatable material has a first or initial viscosity and is in contact with the surface of the substrate 22. The opposite surface of the coatable material forming a first major surface of the coated substrate. Means are provided for changing the viscosity of the coatable material from the first or initial viscosity to a second viscosity. In some embodiments, the means for changing the viscosity comprises a means for increasing the viscosity of the coatable material from a first lower viscosity (e.g., as a liquid, paste or gel-like material) to a second higher viscosity (e.g., a partially cured, thickened, somewhat hardened solid). In other embodiments, means for changing the viscosity of the coatable material comprises means for decreasing the viscosity of the coatable material from a first higher viscosity to a second lower viscosity.

In embodiments where the coated substrate has been prepared or obtained in advance of the remainder of the process described herein (e.g., is supplied in the form of a pre-coated substrate), the coatable material is already disposed on the substrate and is likely to already be in a partially cured, thickened or semi-hardened state. In these embodiments, means for changing the viscosity of the coatable material may comprise means for lowering the viscosity of the coatable material to soften it and prepare the first surface of the coated substrate for treatment with face-side rollers, as described herein. In such an embodiment, the pre-coated substrate may be treated to soften the coatable material prior to treatment with face-side rollers to impart a matte finish thereon. Softening of the coated substrate may be accomplished in any suitable manner such as by heating.

In the system 20 of FIG. 1, the coated substrate 30 is conveyed over idler rollers 32, to a second station 34, where the coated substrate is subjected to conditions to change the viscosity by increasing the viscosity of the coatable material from an initial or first viscosity to a second viscosity, the second viscosity being greater than the initial viscosity. In embodiments of the invention, the coatable material, when first applied to the substrate, is typically liquid or gel-like and is flowable or spreadable so as to form a liquid or gel-like film of material on a major surface of the substrate 22. The coatable material may comprise at least one curable component.

In some embodiments, the coatable material includes at least one solvent and the coatable material is applied directly to the substrate 22. In other embodiments, the coatable material may be solvent-less (e.g., 100% solids) and the coatable material may be applied to a roller and then transferred to the substrate 22.

Second station 34 provides means for changing the viscosity of the coatable material. In the depicted embodiment, the means for changing the viscosity is a means for increasing the viscosity of the coatable material. In embodiments in which the coatable material includes at least one solvent, means for increasing the viscosity of the coatable material may be provided in the form of a heat source such as an oven, a heating element or the like wherein the coatable material is subjected to elevated temperatures sufficient to drive off solvent and/or partially cure at least one component in the coatable material. While in the second station 34, the viscosity of the coatable material is raised to a second or higher viscosity to render the coatable material sufficiently hardened, dried and/or cured to endure further processing, as is described herein. The exact temperature of the second station 34 will depend, in part, on the composition of the coatable material, the desired viscosity of the coatable material after it exits the second station 34 and the amount of time a coated substrate dwells within the station 34.

In some embodiments, the coatable material may be a polymerizable material in which the polymerization reaction is initiated by the application of electromagnetic radiation. In those embodiments, means for increasing the viscosity of the coatable material may comprise a source of electromagnetic radiation, i.e., ultraviolet (UV) radiation, infrared (IR) radiation, x-rays, gamma-rays, visible light or the like. In some embodiments, the means for increasing the viscosity of the coatable material comprises an electron beam (e-beam) source and the coatable material is curable or otherwise hardens when exposed to an e-beam. In embodiments of the invention wherein the means for changing the viscosity of the coatable material involves temperature control for heating or cooling of the coatable material from a first viscosity to a second viscosity, various mechanisms are contemplated. In some embodiments, the means for changing the viscosity of the coatable material is a temperature-controlled chamber or oven through which the coated substrate passes to adjust the viscosity of the coatable material. In other embodiments, the means for changing the viscosity of the coatable material comprises a temperature-controlled roll that contacts the coated substrate 30 as it advances through the system 20. In some embodiments, means for changing the viscosity of the coatable material comprises a plurality of temperature-controlled rollers. In other embodiments, means for changing the viscosity of the coatable material may comprise a source of temperature-controlled gas. In still other embodiments, means for changing the viscosity of the first coatable material comprises temperature-controlled liquid.

In some embodiments, the coatable material is applied to the substrate as a solventless (e.g. 100% solids) composition that may be hardened by cooling. Moreover, the coatable material may initially be heated to reduce its initial viscosity and thereby facilitate the initial application of the coatable material onto the substrate 22. Thereafter, the coated substrate 30 may be cooled to increase the viscosity of the coatable material.

In other embodiments, the coatable material may not require either heating or cooling in order to attain an acceptable second viscosity. For some coatable materials in some systems, exposure of the coated substrate in air under ambient conditions may be sufficient to harden the coatable material to permit further processing, as described herein.

Referring again to the system 20 of FIG. 1, coated substrate 30 is conveyed from second station 34 to third station 36 where the second major surface of the coatable material directly contacts one or more face-side rollers 38. In the embodiment shown in FIG. 1, face-side rollers comprise three rollers 38*a*, 38*b*, 38*c*. It will be understood that fewer face-side rollers (e.g., less than three) or additional face-side rollers (e.g., four or more) may be included within the third station 36. Coated substrate 30 is maintained in sufficient tension around face-side rollers 38 to generate a matte finish on the second major surface of the coatable material, as is further described herein.

In achieving a matte finish, the coatable material will be at a second viscosity at which the coatable material is not as easy to deform when pressed against face-side rollers 38 as it was when coatable material was first dispensed by the extrusion die 28. In the appropriate environment (e.g., light, electromagnetic radiation, temperature, humidity, etc.), the coatable material will not be excessively hardened to the point that no finish can be imparted to the second major surface of the precursor by face-side rollers 38. Face-side rollers 38 may be selected from any of a variety of rollers made of diverse materials including, without limitation, steel, aluminum, chromed steel, elastomer or elastomer covered rolls such as nitrile rubber surfaced rollers, wood, polymer, ceramic, plastic and the like. In embodiments of the invention, the surface of the face-side rollers is relatively smooth and unremarkable in its topography. However, in some embodiments, face-side rollers 38 may include a design pattern or other identifiable surface feature for imparting a nonrandom pattern and topography onto the second major surface of the coatable material. Such additional features, however, are not typically responsible for imparting the desired matte finish. As is shown in FIG. 1, the face-side roller 38 is positioned in a manner that facilitates contact between the face-side roller and the major surface of the coated substrate.

In some embodiments, the face-side rollers 38 may be heated so that the coatable material is also heated as it contacts the roller 38. In other embodiments, face-side rollers 38 may be chilled or cooled so that the coatable material is also chilled or cooled as it contacts the surface of the rollers 38.

Not wishing to be bound to any particular theory, it is believed that a matte finish is imparted to the second major surface by the interaction of the second major surface of the coatable material and the unremarkable surface of the face-side rollers, whereby the coatable material is of sufficient tack that a portion of the precursor material adheres to the surface of the face-side roller. At this point in the process, the coatable material has been subjected to conditions at the second station 34 so that the precursor is cohesive and resistant to flow and will not excessively transfer to the surface of face-side roller 38 or deform when pressed against the face-side roller. However, the outermost layer of the second major surface of the coatable material, adhere to the face-side roller, and then release therefrom to create a surface topography sufficient to impart a matte finish that can be viewed in detail under magnification.

Again, not wishing to be bound by any theory, in some embodiments, a small volume of coatable material may initially adhere to a face-side roller 38. A steady-state condition is typically achieved as coatable material is continually released from the face-side roller 38 at nearly the same rate at which coatable material is picked up by the face-side roller. In other words, an incoming segment of the coated substrate 30 includes coatable material that contacts a face-side roller that has been pre-wetted with the same coatable material from an upstream segment of the coated substrate. As the segment of coatable material contacts the face-side roller, it picks up some of the coatable material already deposited on the roller. As the same segment of coated substrate departs the face-side roll, a portion of the surface layer of the coatable material on the coated substrate splits away so that some of the coatable material remains on the face-side roller while a net amount of coatable material remaining on the substrate is, on average, equal to the amount of the coatable material incoming to the face-side roll.

The process of the invention provides a matte finish without slavishly reproducing the surface features of the face-side roller, and the process of the invention is not a conventional embossing process. Comparisons made during a microscopic examination of the surfaces of the face-side rollers and the resulting matte finish on the second major surface of the coatable material demonstrate that the face-side roller surfaces and the resulting matte finish are not mirror images of one another.

The coated substrate 30 exits the third station 36 with a matte surface finish imparted to the surface thereof by the face-side rollers 38. Means for further hardening the coatable material are provided in the form of an optional fourth station 40 where the coated substrate 30 is exposed to conditions to harden or cure the coatable material. The fourth station 40 is optional in that the coatable material may not require such a treatment.

In the system 20 shown in FIG. 1, the fourth station 40 includes a source 42 which may be a heat source or a source of electromagnetic radiation such as ultraviolet (UV) or infrared (IR) radiation, visible light, x-rays, gamma-rays, e-beam or the like. In some embodiments, the fourth station is an oven capable of thermally curing the coatable material. In other embodiments, the fourth station is a radiation source capable of initiating a curing reaction within the coatable material. In still other embodiments, the fourth station 40 may comprise a combination of heat and radiation curing, optionally with forced air drying or other features known to those skilled in the art. In still other embodiments, the fourth station may comprise a plurality of individual stations or a plurality of sources similar or analogous to the source 42. In some embodiments, fourth station 40 may be configured to apply the same type of treatment applied by second station 34 (e.g., heating or cooling). An optional deflector or shield 44 deflects heat or radiation emitted from the source 42 and directs it toward the coatable material on the coated substrate 30.

In some embodiments, means for hardening the coatable composition comprises exposure to ambient conditions while, for example, a free radical polymerization process within the coatable material runs to completion.

Following hardening, the coated substrate 30 may be conveyed to another station (not shown) such as a cutting station to cut the continuous coated substrate into smaller discrete sections. Alternatively, the coated substrate may be directed to a wind-up station where the continuous coated substrate is wound up on a take-up roll, for example. Other process stations (e.g., a packaging station) may be included in the system 20, depending on the use of the final article.

The present invention provides films and the like having a matte finish that are made from coatable materials via contact with one or more face-side rollers. The invention enables the manufacture of matte finished optical films and the like using initially flowable, low viscosity, coatable materials. Moreover, the use of such flowable, low viscosity, coatable materials enables the manufacture of articles having thin films coated onto a suitable substrate. In some embodiments, the resulting thin film is at least about 1 micron thick. In some embodiments, the resulting thin film is provided with a thickness between about 1 micron and about 10 microns on top of the substrate. In still other embodiments, the coated thickness of the resulting film is greater than about 10 microns.

In the foregoing embodiment, the plurality of face-side rollers 38 can be provided in other arrangements and configurations, all contemplated within the scope of the present invention. The various arrangements of face-side rollers, embodiments of which are discussed below, can alter the properties of the final matte finish. Additionally, the final matte finish can be influenced by controlling the temperature of the coated substrate within third station 36. Thermal control of the coated substrate at this stage of the manufacturing process can further influence the viscosity of the coatable material and the behavior of the coatable material on the face-side rollers 38 as previously discussed, where a portion of the surface layer of the coatable material on the coated substrate splits with some of the coatable material remaining on the face-side roller while a net amount of coatable material remains on the substrate. Means for hardening the coatable material can include the heating or cooling of the third station 36 by, for example, heating the face-side rollers so that the coated substrate 30 is also heated, thus changing the properties (e.g., viscosity) of the coatable material and the manner in which the surface of the coatable material may split between the face-side rollers and the substrate. By changing the manner in which the coated substrate interacts with the face-side rollers, the quality and/or properties (e.g., optical properties) of the matte finish can also be changed.

In some embodiments, both the face-side rollers and the coated substrate are exposed to heating or cooling conditions in a manner that influences the viscosity of the coatable material as it is exposed to the face-side rollers. Thermal control of third station 36 can be accomplished by enclosing third station 36 to permit heating/cooling of the atmosphere therewithin.

In other embodiments, thermal control of face-side rollers 38 can be achieved by directly heating or cooling the face-side rollers and/or backing rollers. Such heating or cooling can be accomplished in a known manner (e.g., by use of heating coils or by circulating fluids through the rollers) in order to change the viscosity of the first coatable material. Other arrangements for the thermal control of the third station 36 and/or the face-side rollers 38 are within the skill of those practicing in the field.

In some embodiments, the entire system 20 may be enclosed to prevent coatable material (e.g., resin) on the face-side rollers 38 from hardening (e.g., polymerizing) under ambient light. Such an enclosure may be provided in the form of a shroud constructed to block the transmission of light or other electromagnetic radiation while being transparent enough to facilitate viewing of the process. In some embodiments, the enclosure or shroud may be configured so that it can be purged (e.g., with filtered gas) to further minimize contamination on the face-side rollers. Moreover, in systems employing a polymerizable material as the coatable material, the purge gas is chosen to prevent premature curing. The enclosure may also be equipped to collect volatilized or aerosol dispersed coating material.

Operation of the foregoing process in a "clean" environment may be desirable to prevent defect formations in the coating caused by, for example, one or more stray particles in the coatable material. Unwanted particles can disrupt the desired contact between the coated film and the face-side roller(s), thus creating a "point" defect in the vicinity of the particle.

Figure 2:
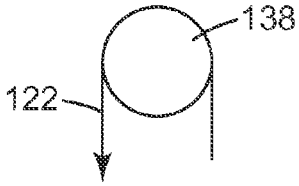
FIG. 2 is a schematic view of a portion of a system for providing a matte finish on a film according a second embodiment of the present invention.

Referring to FIG. 2, another embodiment is shown in schematic for the arrangement of face side rollers according to the present invention. In FIG. 2, a single face-side roller 138 provides the matte finish to the coatable material disposed on substrate 122. The face-side roller 138 may be inserted into the system 20 shown in FIG. 1 in place of the face-side rollers 38*a*, 38*b* and 38*c* within third station 36.

Figure 3:
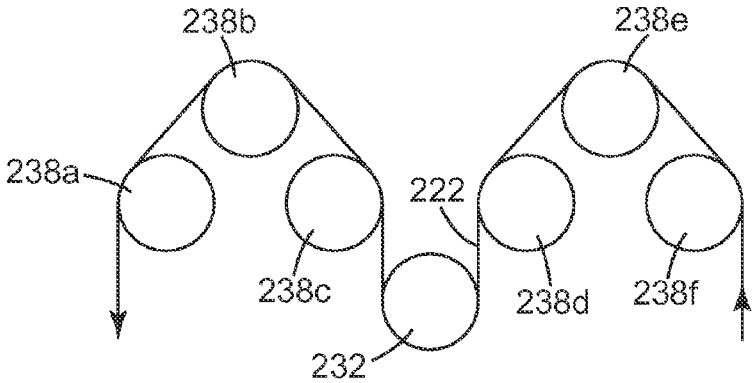
FIG. 3 is a schematic view of a portion of a system for providing a matte finish on a film according a third embodiment of the present invention.

In another embodiment, a greater number of face-side rollers may be used, as shown in FIG. 3, for example. In the depicted embodiment, a plurality of six face-side rollers 238*a-f* are used to impart a matte finish on the coatable material disposed on substrate 222. In the depicted arrangement, the face-side rollers 238 are grouped in two sets of three rollers each, rollers 238*a-c* being a first group of face side rollers, and rollers 238*d-f* being a second group of face-side rollers. Idler roller 232 guides the coated substrate 222 between the two groups of face-side rollers. Again referring to the system 20 in FIG. 1, the plurality of face-side rollers 238 of FIG. 3 may be substituted into the system 20 in place of the face-side rollers 38*a-c* in third station 36

Figure 4:
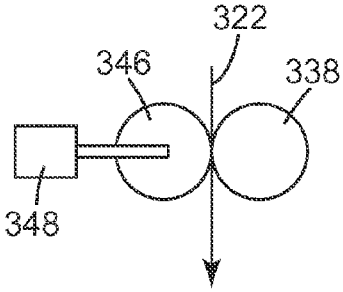
FIG. 4 is a schematic view of a portion of a system for providing a matte finish on a film according a fourth embodiment of the present invention.

Other combinations of face-side rollers are also contemplated. In another embodiment, a face-side roller may be brought into contact with the second surface of the coatable material using a nip arrangement as shown in FIG. 4, for example. In this embodiment, face-side roller 338 is paired with a backing roller 346. The face-side roller contacts the second surface of the coatable material on coated substrate 322 which is carried on backing roller 346. The coated substrate 322 is conveyed between the face-side roller 338 and the backing roller 346 with the backing roller capable of being moved relative to the face-side roller 346 to thereby move the second surface of the coatable material on coated substrate 322 into contact with face side roller 338 as well as to adjust the force at which the second surface is held against the face-side roller 338. In the embodiment of FIG. 4, actuator 348 is provided to control the placement of the coated substrate 322 with respect to the face-side roller 338. Actuator 348 can be of any appropriate design including without limitation pneumatic, hydraulic, piezoelectric, electromechanical and the like. In this manner, pressure is exerted on the face-side roller 338 through the actuator 348 in a controlled manner.

It will be appreciated that the nip arrangement of face-side roller 338 paired with backing roller 346 can be combined with other configurations of face side rollers, including those embodiments already discussed with respect to FIGS. 1-3. The nip arrangement can be configured within the system 20 of FIG. 1, for example, to receive the coated substrate fed from face-side roller 38C prior to exposing the coated material to conditions sufficient to achieve a final hardening or curing, as are provided in fourth station 40. Similarly, face-side roller 338 and backing roller 346 can be combined with face-side rollers of FIG. 2 so that the coated substrate 122 leaving face-side roller 138, for example, is routed through the nip arrangement of FIG. 4. Likewise, face-side roller 338 and backing roller 346 can be combined with face-side rollers of FIG. 3 so that the coated substrate 222 leaving face-side roller 238*a*, for example, is routed through the nip arrangement of FIG. 4. Alternatively, single or multiple nip arrangements similar to the one depicted in FIG. 4 may precede or reside between any number of face-side rollers and arrangements.

In embodiments of the invention, multiple (e.g., two or more) face-side rollers are employed in the creation of the desired finish. In some embodiments, the multiple face-side rollers are of varying diameters. In some of these embodiments, each of the face-side rollers will be of a different diameter. Other arrangements of face-side rollers will be apparent to those of ordinary skill in the art, and all such arrangements are contemplated as being within the scope of the invention. The wrap angle of the substrate and coating around each face-side roll may also be varied by those skilled in the art to impart different levels of matte-finish and optical properties.

In another aspect of the invention, a method of providing a film with a matte finish is provided. The method includes providing a coated substrate comprising a coatable material on a substrate. In some embodiments, the providing step comprises providing a pre-coated substrate that can be fed directly into the system described herein. In other embodiments, the providing step comprises the step of making the coated substrate by applying a coatable material onto a substrate, the coatable material having an initial viscosity, the coatable material and the substrate forming a coated substrate in which the coatable material has a first major surface in contact with the first major surface of the substrate and a second major surface opposite the first major surface. Once the coated substrate is provided, the method of the invention comprises changing the viscosity of the coatable material from the initial viscosity to a second viscosity; contacting the second major surface of the coatable material with at least one face-side roller to impart a matte finish; and, optionally, hardening the coatable material to provide the film having a matte finish.

Coatable materials suitable for use in the present invention may comprise any of a variety of film forming materials. In some embodiments, the coatable material is a polymeric material comprised of one or more polymers and/or oligomers in solvent. In some embodiments, the coatable material is a mixture of one or more monomers, oligomers and/or polymers in one or more solvents. In other embodiments, the coatable material includes the foregoing oligomer(s), monomer(s) and/or polymer(s) in one or more solvents along with a volume of particles or nanoparticles.

Nanoparticles can be surface modified which refers to the fact that the nanoparticles have a modified surface so that the nanoparticles provide a stable dispersion. "Stable dispersion" refers to a dispersion in which the colloidal nanoparticles do not agglomerate after standing for a period of time, such as about 24 hours, under ambient conditions, e.g., room temperature (about 20-22° C.), and atmospheric pressure, without extreme electromagnetic forces.

Surface-modified colloidal nanoparticles can optionally be present in a polymer coating used as a coatable composition herein with nanoparticles present in an amount effective to enhance the durability of the finished or optical element. The surface-modified colloidal nanoparticles described herein can have a variety of desirable attributes, including, for example, nanoparticle compatibility with a coatable composition such that the nanoparticles form stable dispersions within the coatable composition, reactivity of the nanoparticle with the coatable composition making the composite more durable, and a low impact or uncured composition viscosity. A combination of surface modifications can be used to manipulate the uncured and cured properties of the composition. Surface-modified nanoparticles can improve optical and physical properties of the coatable composition such as, for example, improved resin mechanical strength, minimized viscosity changes while increasing solids volume loading in the coatable composition and maintain optical clarity while increasing solid volume loading in the coatable composition.

In some embodiments, the nanoparticles are surface-modified nanoparticles. Suitable surface-modified colloidal nanoparticles can comprise oxide particles. Nanoparticles may comprise a range of particle sizes over a known particle size distribution for a given material. In some embodiments, the average particle size may be within a range from about 1 nm to about 100 nm. Particle sizes and particle size distributions may be determined in a known manner including, for example, by transmission electron microscopy (TEM). Suitable nanoparticles can comprise any of a variety of materials such as metal oxides selected from alumina, tin oxide, antimony oxide, silica, zirconia, titania and combinations of two or more of the foregoing. Surface-modified colloidal nanoparticles can be substantially fully condensed.

In some embodiments, silica nanoparticles can have a particle size ranging from about 5 to about 75 nm. In some embodiments, silica nanoparticles can have a particle size ranging from about 10 to about 30 nm. Silica nanoparticles can be present in the coatable composition in an amount from about 10 to about 100 phr. In some embodiments, silica nanoparticles can be present in the coatable composition in an amount from about 25 to about 80 phr, and in other embodiments, silica nanoparticles can be present in the coatable composition in an amount from about 30 to about 70 phr. Silica nanoparticles suitable for use in the coatable compositions of the present invention are commercially available from Nalco Chemical Co. (Naperville, Ill.) under the product designation NALCO COLLOIDAL SILICAS. Suitable silica products include NALCO products 1040, 1042, 1050, 1060, 2327 and 2329. Suitable fumed silica products include for example, products sold under the tradename AEROSIL series OX-50, -130, -150, and -200 available from DeGussa AG, (Hanau, Germany), and CAB-O-SPERSE 2095, CAB-O-SPERSE A105, CAB-O-SIL MS available from Cabot Corp. (Tuscola, Ill.) Surface-treating the nanosized particles can provide a stable dispersion in the coatable composition (e.g., a polymeric resin). Preferably, the surface-treatment stabilizes the nanoparticles so that the particles will be well dispersed in the coatable composition and results in a substantially homogeneous composition. Furthermore, the nanoparticles can be modified over at least a portion of its surface with a surface treatment agent so that the stabilized particle can copolymerize or react with the coatable composition during curing.

Metal oxide nanoparticles can be treated with a surface treatment agent. In general, a surface treatment agent has a first end that will attach to the particle surface (covalently, ionically or through strong physiosorption) and a second end that imparts compatibility of the particle with the coatable composition and/or reacts with coatable composition during curing. Examples of surface treatment agents include alcohols, amines, carboxylic acids, sulfonic acids, phosphonic acids, silanes and titanates. The type of treatment agent can depend on the nature of the metal oxide surface. For example, silanes are typically preferred for silica and other siliceous fillers. Surface modification can be accomplished either subsequent to mixing with the coatable composition or after mixing. It may be preferred in the case of silanes to react the silanes with the particle or nanoparticle surface before incorporation into the coatable composition. The amount of surface modifier can depend on factors such as particle size, particle type, modifier molecular weight, and modifier type. In general, a monolayer of modifier is attached to the surface of the particle. The attachment procedure or reaction conditions required also depend on the surface modifier used. For silanes, surface treatment may take place at elevated temperatures under acidic or basic conditions during a period of 1 hour up to about 24 hours.

Surface treatment agents suitable for particles to be included in the coatable composition include compounds such as, for example, isooctyl trimethoxy-silane, N-(3-triethoxysilylpropyl)methoxyethoxyethoxyethyl carbamate (PEG3TES), Silquest A1230, N-(3-triethoxysilylpropyl) methoxyethoxyethoxyethyl carbamate (PEG2TES), 3-(methacryloyloxy)propyltrimethoxysilane, 3-acryloxypropyltrimethoxysilane, 3-(methacryloyloxy)propyltriethoxysilane, 3-(methacryloyloxy)propylmethyldimethoxysilane, 3-(acryloyloxypropyl)methyldimethoxysilane, 3-(methacryloyloxy)propyldimethylethoxysilane, 3-(methacryloyloxy) propyldimethylethoxysilane, vinyldimethylethoxysilane, phenyltrimethoxysilane, n-octyltrimethoxysilane, dodecyltrimethoxysilane, octadecyltrimethoxysilane, propyltrimethoxysilane, hexyltrimethoxysilane, vinylmethyldiacetoxysilane, vinylmethyldiethoxysilane, vinyltriacetoxysilane, vinyltriethoxysilane, vinyltriisopropoxysilane, vinyltrimethoxysilane, vinyltriphenoxysilane, vinyltri-t-butoxysilane, vinyltris-isobutoxysilane-, vinyltriisopropenoxysilane, vinyltris(2-methoxyethoxy)silane, styrylethyltrimethoxysilane, mercaptopropyltrimethoxysilane, 3-glycidoxypropyltrimethoxysilane, acrylic acid, methacrylic acid, oleic acid, stearic acid, dodecanoic acid, 2-[2-(2-methoxyethoxy)ethoxy]acetic acid (MEEAA), beta-carboxyethylacrylate, 2-(2-methoxyethoxy)acetic acid, methoxyphenyl acetic acid, and mixtures of two or more of the foregoing.

Surface modification of the particles in a colloidal dispersion can be accomplished in a number of ways. The process involves the mixture of an inorganic dispersion with surface modifying agents and, optionally, a co-solvent such as, for example, 1-methoxy-2-propanol, ethanol, isopropanol, ethylene glycol, N,N-dimethylacetamide and 1-methyl-2-pyrrolidinone. Co-solvent can be added to enhance the solubility of the surface modifying agents as well as the surface modified particles. The mixture comprising the inorganic sol and surface modifying agents is subsequently reacted at room or an elevated temperature, with or without mixing. In one method, the mixture can be reacted at about 85° C. for about 24 hours, resulting in the surface-modified sol. In one method, where metal oxides are surface-modified, the surface treatment of the metal oxide can involve the adsorption of acidic molecules to the particle surface. The surface modification of the heavy metal oxide preferably takes place at room temperature.

In some embodiments, the finished article will include particles suitable for a particular use such as, for example, abrasive applications. In such embodiments, the type of particle used, the average particle size and the particle size distribution will be determined according to the intended application, as known by those skilled in the art. Moreover, the particles used in the manufacture of such articles may include, without limitation, particles comprising the foregoing materials as well as particles intended for a use in a particular abrasive application such as those comprising diamond, alumina, corundum, emery and combinations of two or more of the foregoing.

In some embodiments, the average particle sizes (e.g., particle diameter) may be within the range from about 0.05 micron to about 60 microns. In addition to the foregoing particle sizes, use of smaller and larger average particle sizes are also contemplated. In embodiments of the invention, at least a portion of the foregoing particles may be surface modified in the manner described above. In other embodiments, all of the particles are surface modified. In still other embodiments, none of the particles are surface modified.

The end product of the foregoing manufacturing process is a film having a matte finish thereon. The film may be used in any of a variety of applications. In some embodiments, the film resulting from the foregoing process is used in optical applications as a cover for an electronic display screen such as a computer monitor, television screen, game console, or the like. In other embodiments, the matte-finish film may be used as a film or tape to cover cosmetic flaws on a surface such as an automobile finish or the like. In the latter use, an adhesive layer may be applied to the major surface of the substrate opposite the surface to which the coatable material is applied.

In other embodiments, the articles resulting from the foregoing manufacturing process may be made for use in decorative applications where the matte finish is provided on predetermined discrete portions of the coatable material. In such embodiments, one or more face side roller can include a patterned surface so as to provide discrete regions of matte finish. In still other embodiments, the foregoing process may be used to provide privacy filters or films for use on computer screens, windows, optical panels/surfaces/substrates and the like.

In some embodiments, the foregoing process is used to manufacture an article as previously described, wherein the coatable material comprises more than one phase. In aspects of this embodiment, the coatable material is applied to the substrate to provide a coated substrate having a phase-separated coatable material thereon. The coatable material may be formulated and applied to the substrate so that it forms two or more phases after application to the substrate. In another aspect, the coatable material may be formulated and allowed to phase separate prior to its application to the substrate. In either aspect, the resulting coatable material may then be hardened, as previously described, resulting in a phase-separated film layer on a major surface of the substrate. The phase-separated film layer is then further processed to provide a matte surface, according to the present invention.

In a further embodiment, the process of the invention is included as part of a larger or more complex process capable of providing articles (e.g., films) having the aforementioned optical properties as well as other properties. For example, articles having harder polymeric coatings may be desired. Depending on the materials used, harder coatings may require a minimum thickness in order to obtain desired mechanical properties such as abrasion resistance while obtaining the desired optical properties of a matte finish may require a thinner coating or layer of coatable material. In a tandem process, according to the present invention, a first coating of a first coatable material could be applied to the substrate to obtain the needed thickness, and a subsequent application of a second coatable material may be applied to the surface of the first coatable material. The first coatable material may be solidified (e.g., cured) without subjecting it to treatment by the face-side rollers. The second coatable material can then be applied to the surface of the first coatable material and treated with face-side rollers as described herein to obtain the desired matte finish on the surface of the finished article.

In other embodiments of the invention, a process is provided to manufacture articles (e.g., films) wherein a coatable composition is applied to both sides of the substrate, either sequentially or simultaneously. In a sequential dual side coating process, an article made as described above with reference to FIG. 1, the coated substrate 30 may be re-directed from the fourth station 40 into first station 24 where a second layer of coatable material would be applied to the opposite or previously uncoated side of the substrate 22. Thereafter, the second layer of coatable material would be processed in the same manner as previously described with respect to the system 20. In some embodiments, the second layer of coatable material would also be subjected to treatment by face-side rollers to impart a matte finish thereon so that the resulting article comprises a substrate having a layer of hardened coatable material on each major surface thereof and wherein each layer of the hardened coatable material includes a matte finish. In other embodiments, the second layer of coatable material is applied to the previously uncoated major surface of the substrate and hardened without subjecting the second layer to a surface finishing treatment by face-side rollers. Articles provided in the foregoing process comprise substrate having a layer of hardened coatable material on each major surface thereof wherein only one layer of the hardened coatable material includes a matte finish. In the foregoing embodiment, it is contemplated that each layer of hardened coatable material may be the same composition or they may be different.

In a simultaneous dual side coating process, first and second coatable materials are applied simultaneously to both sides of a substrate to provide a dual coated substrate with a first coatable material on a first major surface of the substrate and a second coatable material on the second major surface of the substrate. Suitable coating methods include vertical coating, wherein the substrate is fed vertically through a coating station for the simultaneous application of the first coatable material and second coatable material to both sides of the substrate. The first and second coatable materials can be the same materials or they can be different. Thereafter, the second layer of coatable material would be processed in a similar manner as previously described with respect to the system 20 by hardening the first coatable material and the second coatable material simultaneously with a heat source, e-beam source, a source of the electromagnetic radiation, a combination of the foregoing or the like. Thereafter, the first coatable material and/or the second coatable material may be subjected to treatment by face-side rollers to impart a matte finish thereon so that the resulting article comprises a substrate having a layer of hardened coatable material on each major surface thereof and wherein one or both of the layers of the hardened coatable material includes a matte finish. Articles provided in the foregoing simultaneous process comprise a substrate having a layer of hardened coatable material on each major surface thereof. It is contemplated that each layer of hardened coatable material may be the same composition or they may be different.

EXAMPLES

Embodiments of the invention are further described in the following non-limiting Examples.

Example 1 and Comparative A

A system similar to that shown in FIG. 1 was arranged on a HIRANO MULTI COATER™ Model M-200 coating machine, commercially available from Hirano Tecseed Company, Ltd. of Nara, JP. The line speed was 10 feet per minute (3.05 meters/minute), and a coating die of the type discussed in co-assigned U.S. Pat. No. 5,639,305 was used to deposit a 4 inch (10.16 cm) wide layer of a coatable material at various thicknesses, onto a 9 inch (22.86 cm) wide, 5 mil (0.127 mm) thick substrate of commercially available pre-primed polyethylene terephthalate (PET) film obtained from DuPont Teijen Films U.S. under the trade designation MELINEX 618. The coatable material (referred to herein as "PETA") was a photopolymerizable dispersion with solids consisting mainly of 51% by weight pentaerythritoltriacrylate ("SR-444" from Sartomer Company, Inc. of Exton, Pa.) and 37% by weight reaction product of colloidal silica ("Nalco 2327" from Nalco Company of Naperville, Ill.) and 3-trimethoxysilylpropyl methacrylate ("A174" from Momentive Performance Materials of Wilton, Conn.). Other solid additives were 8% by weight n,n-dimethylacrylamide ("NNDMA" from Sigma-Aldrich Company of St. Louis, Mo.), 2.4% by weight 1-hydroxy-cyclohexyl-phenylketone ("Irgacure 184 from Ciba Specialty Chemicals of Newport, Del.), 2% by weight bis (pentamethyl-1,2,2,6,6 piperidinyl-4) decanoate ("Tinuvin 292" from Ciba Specialty Chemicals of Newport, Del.), 50 ppm phenothiazine (Cytec Industries, Inc. of West Patterson, N.J.) and 400 ppm 2,6-di-tert-butyl-p-cresol (Merisol USA, LLC of Houston, Tex.). The composition was prepared at 30 wt. % solids from a dispersion of approximately 50 wt. % solids in a 2-propanol diluent. A conventional pump fed the coatable material to the die. The coated substrate was conveyed into a convection oven operated at 158° F. (70° C.) with a fan speed set to provide a forced air velocity of 18 ft/sec (5.49 m/s) to remove volatile solvent and raise the viscosity of the coatable material to provide a coated substrate with a higher viscosity coatable material thereon. The raised viscosity coatable material was directed to a station where it was treated with face-side rollers arranged in several different configurations as described in Table 1. Upon exiting the station, the higher viscosity coatable material had acquired a matte finish, and the coated substrate was directed into another station equipped with a UV source (H bulb), commercially available from Fusion UV Systems, Inc., Gaithersburg, Md. The higher viscosity coatable material was exposed to UV energy to cure the polymer and provide a coated layer having a thickness of 2, 4, 6 and 12 microns on top of the substrate.

A comparative example (Comparative A) was prepared in the same manner as described above but without subjecting the PETA coatable material to surface treatment with a face-side roller, thus resulting in glossy films having dried thicknesses of 2, 4 and 6 microns on top of the substrate.

TABLE 1

| Configuration | No. & Roller Type | Diameter | Specification |
|---|---|---|---|
| A | 1 Nitrile-covered | 2.711 in. (6.89 cm) | Nitrile Cover, 65 Shore A Durometer |
| B | 1 Steel | 2.86 in. (7.26 cm) | None |
| C | 3 Nitrile-covered | 2.05 in. (5.21 cm), 2.6 in. (6.6 cm), 2.73 in. (6.93 cm) | Nitrile-covered rollers in series |
| D | 6 Nitrile-Covered | 2.865 in. (7.28 cm), 2.76 in. (7.01 cm), 2.711 in. (6.89 cm), 2.05 in. (5.21 cm), 2.6 in. (6.6 cm), 2.73 in. (6.89 cm) | Nitrile-covered rollers in series, 90 degree wrap on 1st roller |
| E | 6 Nitrile-covered | 2.865 in. (7.28 cm), 2.76 in. (7.01 cm), 2.711 in. (6.89 cm), 2.05 in. (5.21 cm), 2.6 in. (6.6 cm), 2.73 in. (6.89 cm) | Nitrile-covered rollers in series, 180 degree wrap on 1st roller |

Three face-side rollers in series produced features in the coating that were similar in size and shape to those produced by a single face-side roller. Adding a second group of three face-side rollers, for a total of six, produced an additional pattern on top of the pattern generated by the first three face-side rollers. The additional roller contacts appeared to provide a variation in the average coating thickness across the coated width. The cross-web variation in coating thickness was more pronounced in coating thicknesses of 4 um and above. Point defects from particulates or from damaged face-side roll surfaces were minimized by switching from 1 face-side roll to 3 face-side rolls.

Figure 5:
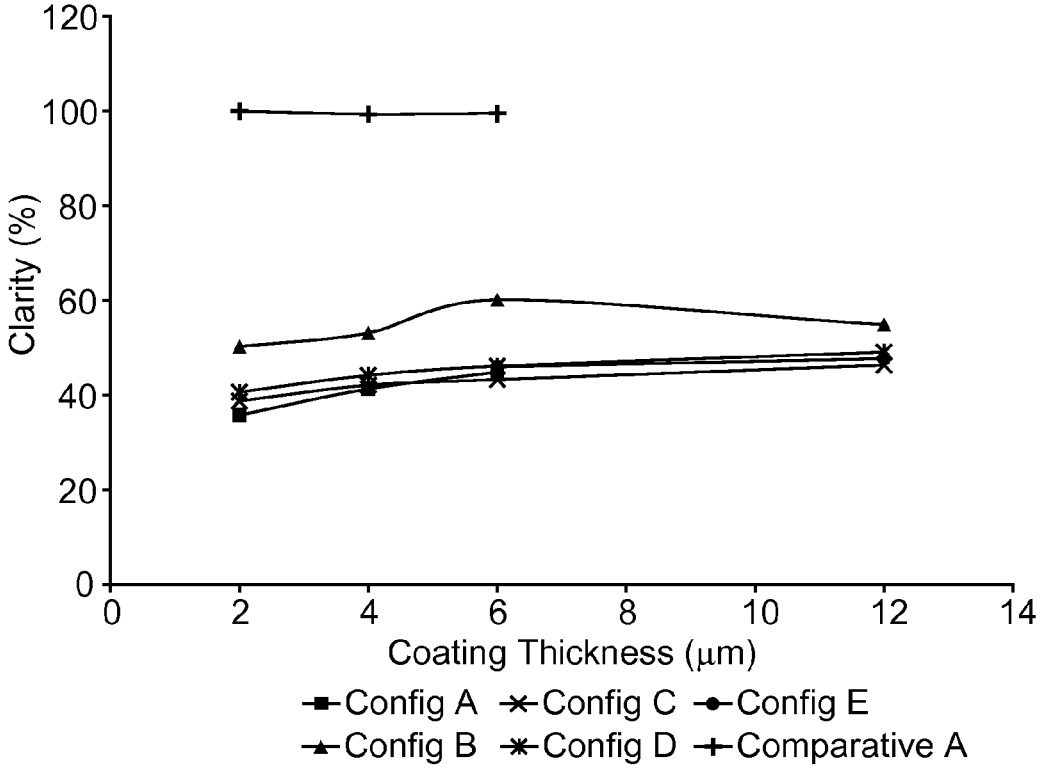
FIG. 5 is a plot of optical clarity as a function of coating thickness for films described in Example 1.
Figure 6:
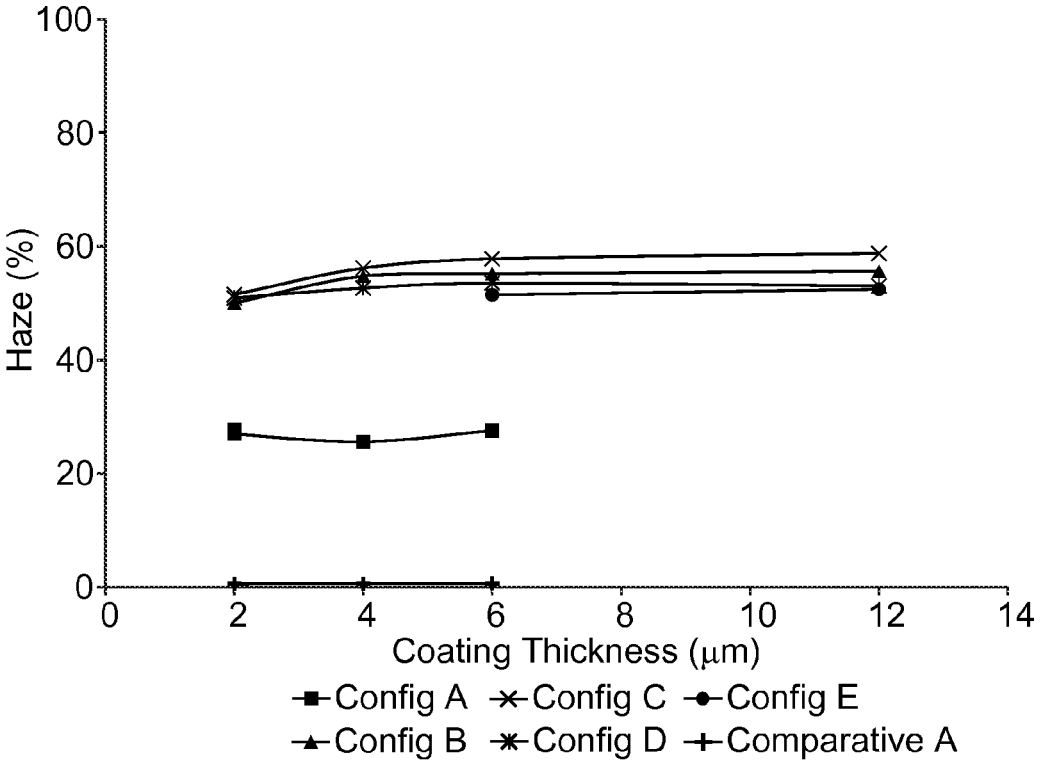
FIG. 6 is a plot of haze as a function of coating thickness for films described in Example 1.
Figure 7:
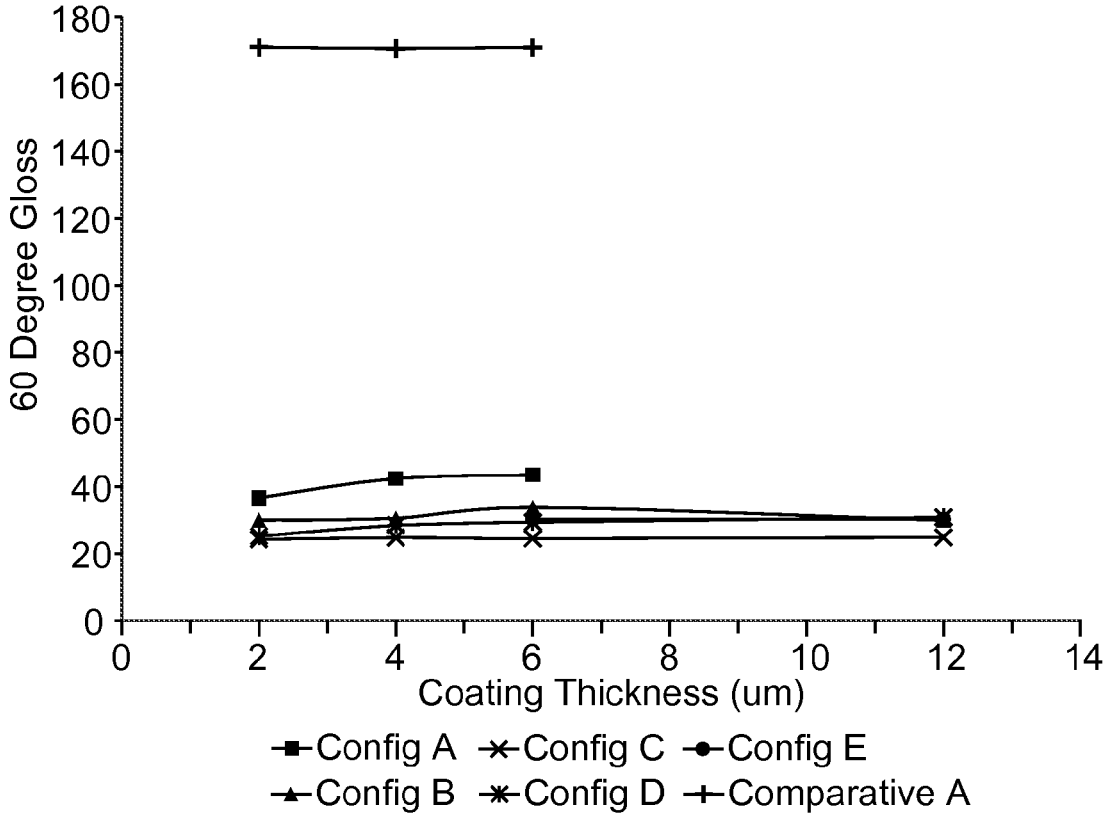
FIG. 7 is a plot of 60 degree gloss as a function of coating thickness for films described in Example 1.

Optical properties of the glossy and matte finish films were measured and compared against the glossy finish of the comparative (without a face side roller treatment). A "Haze-Gard Plus" instrument commercially available from BYK-Gardner of Columbia Md. was used to measure clarity, haze, and a "Micro-Gloss" instrument, also from BYK-Gardner, was used to measure 60 degree gloss. These measurements were plotted and are graphically depicted in FIGS. 5, 6 and 7. FIG. 5 shows a significant difference in clarity between the glossy coating of the comparative and the coatings that had been treated with the various configurations of face-side rollers. The clarity of the glossy film of Comparative A was nearly 100% for coated layers having a thickness of 2, 4 and 6 microns on top of the substrate.

Figure 8:
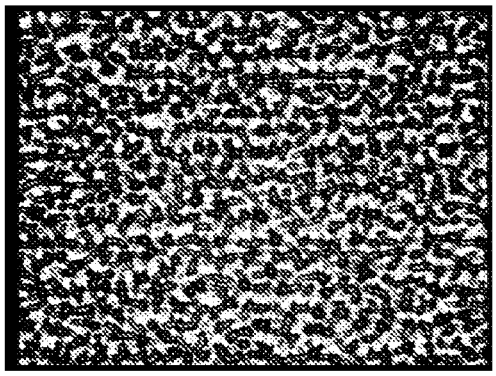
FIG. 8 is a photomicrograph of a portion of the matte surface of an article according to the present invention taken at a magnification of 50×.
Figure 9:
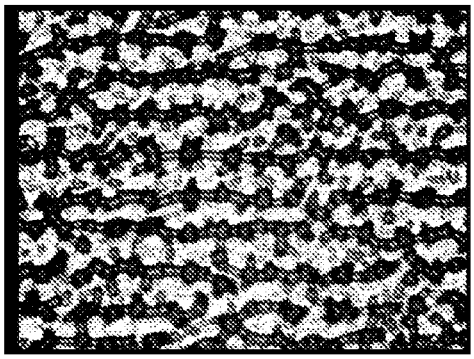
FIG. 9 is a photomicrograph of a portion of the matte surface of an article according to the present invention taken at a magnification of 125×.

The matte surfaces of the various articles were examined with an optical microscope. FIGS. 8 and 9 are microscopy images of a portion of a matte finish on one of the films made using face—side roller in Configuration A (Table 1). The coatable material provided film thickness of about 2 microns on top of the substrate. FIG. 8 is at a magnification of 50× and FIG. 9 is the same surface at a magnification of 125×.

Example 2 and Comparative B

A system similar to that shown in FIG. 1, was arranged on a HIRANO MULTI COATER™ Model M-200 coating machine, commercially available from Hirano Tecseed Company, Ltd. of Nara, JP. The line speed was 100 feet per minute (30.5 meters per minute), and a coating die of the type discussed in co-assigned U.S. Pat. No. 5,639,305 was used to deposit a 4 inch (10.16 cm) wide layer of a coatable material at various thicknesses, onto a 9 inch (22.86 cm) wide, 5 mil (0.127 mm) thick commercially available pre-primed polyethylene terephthalate (PET) film obtained from DuPont Teijen Films U.S. under the trade designation MELINEX 618. The coatable material (referred to herein as "60:40 di-PETA") was a photopolymerizable dispersion with solids consisting mainly of 58% by weight di-pentaerythritolpentaacrylate ("SR-399 from Sartomer Company, Inc. of Exton, Pa.) and 40% by weight reaction product of colloidal silica ("Nalco 2327" from Nalco Company of Naperville, Ill.) and a 60:40 molar blend of 3-trimethoxysilylpropyl methacrylate ("A174" from Momentive Performance Materials of Wilton, Conn.) and isooctyl trimethoxy silane ("BS 1316" from Wacker Chemical Corp. of Adrian, Mich.). Other solid additives were 2% by weight 1-hydroxy-cyclohexyl-phenylketone ("Irgacure 184 from Ciba Specialty Chemicals of Newport, Del.), 71 ppm phenothiazine (Cytec Industries, Inc. of West Patterson, N.J.) and 71 ppm 2,6-di-tert-butyl-p-cresol (Merisol USA, LLC of Houston, Tex.). Before coating, this mixture was diluted to 50% by weight in a 90:10 weight ratio blend of 2-propanol and toluene. A conventional pump fed the coatable material to the die.

The coated substrate was conveyed into a convection oven maintained at 158° F. (70° C.) with a fan speed set to provide a forced air velocity of 18 ft/sec (5.49 m/sec) to remove volatile solvent and raise the viscosity of the coatable material to provide a coated substrate having a higher viscosity material thereon. The higher viscosity coatable material was directed to a station where it was treated with a face-side roller as the coated substrate was conveyed through a nip arrangement between the face-side roller and a backing roller. Face-side and backing rollers with nitrile rubber elastomer covers of different Shore-A durometer were utilized. Matte finish coatings were made with a nitrile covered face-side roller with a Shore-A durometer of 90 and a nitrile covered backing roller with a Shore-A durometer of 30. A rigid roller made of aluminum was also used as a backing roller. The face-side roller was brought into contact with the coated substrate by an actuator in a configuration similar to that shown in FIG. 4, enabling control over the intensity of the load against the backing roll.

Upon exiting the nip, the coatable material had acquired a matte finish, and the coated substrate was directed into another station equipped with a UV source, commercially available from Fusion UV Systems, Inc., Gaithersburg, Md. The hardened coatable material was exposed to UV energy (H bulb) to cure the polymer and provide a coated layer having a thickness of 3 and 4 microns on top of the substrate.

A comparative example (Comparative B) was prepared as in Example 1 without subjecting the PETA coatable material to surface treatment with a face-side roller, providing a film having a dried thickness of 4 microns on top of the substrate.

Figure 10:
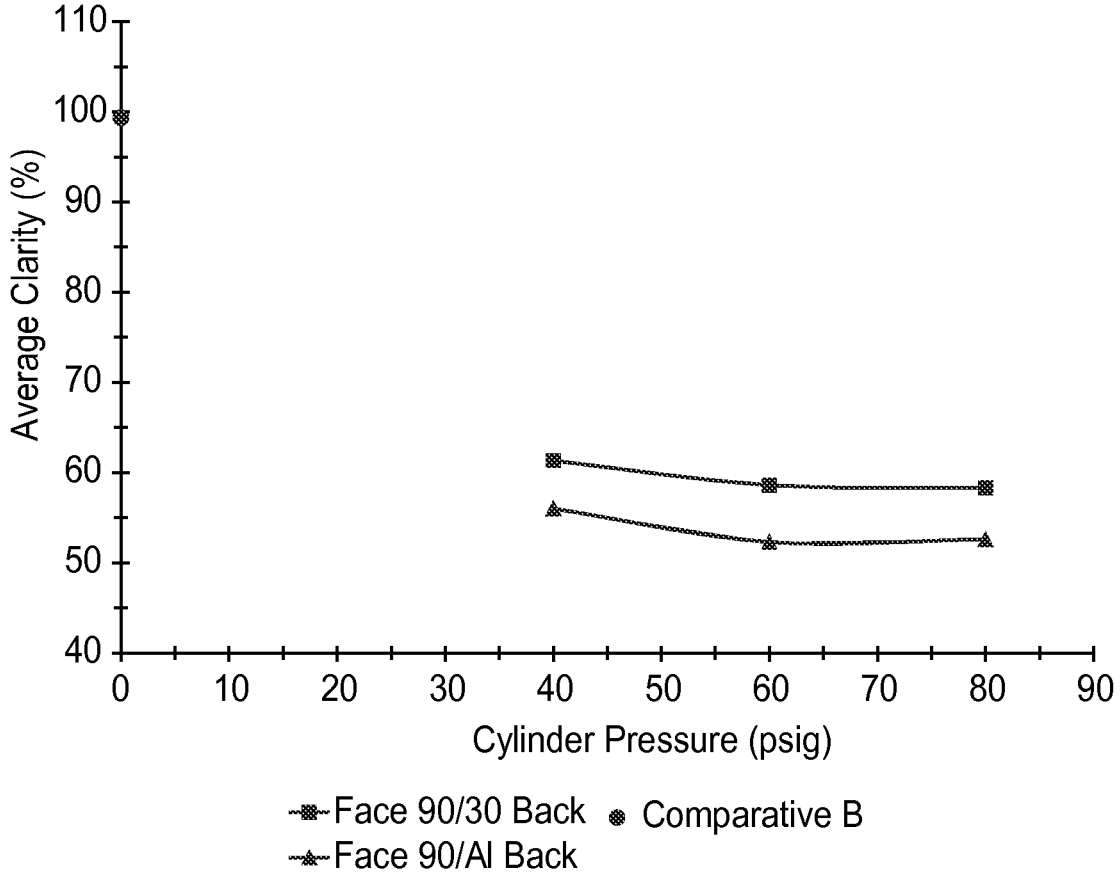
FIG. 10 is a plot of average clarity as a function of cylinder nip pressure for films described in Example 2.
Figure 11:
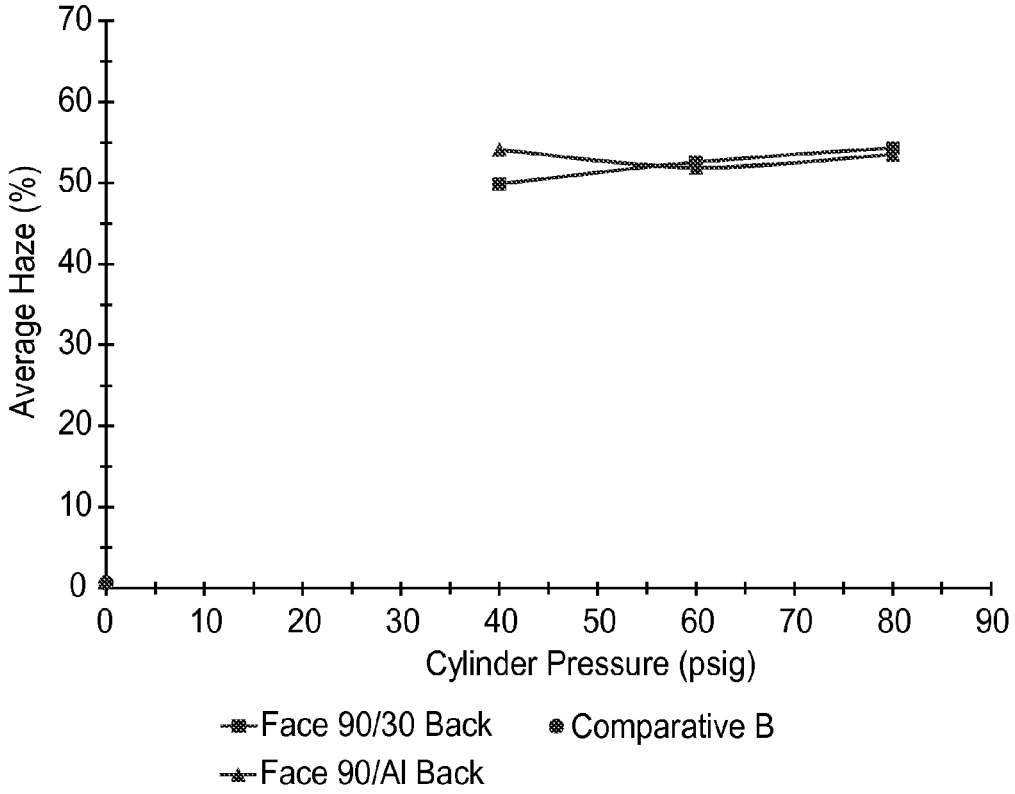
FIG. 11 is a plot of average haze as a function of cylinder nip pressure for films described in Example 2.
Figure 12:
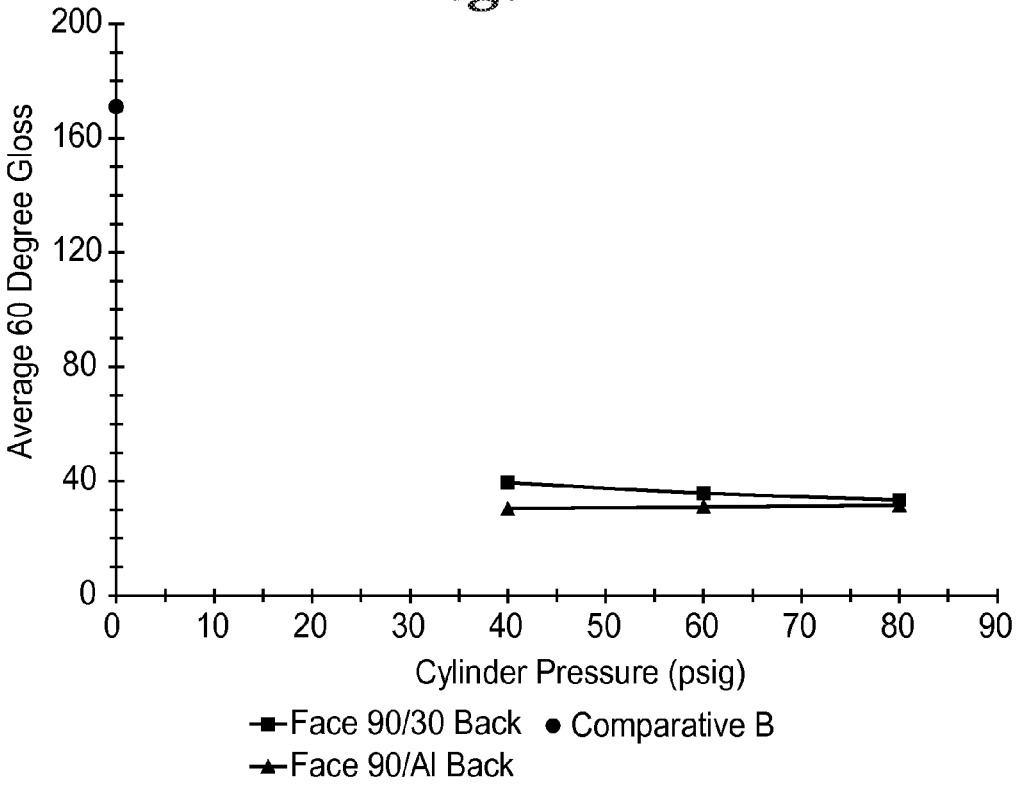
FIG. 12 is a plot of average 60 degree gloss as a function of cylinder nip pressure for films described in Example 2.

The optical properties of the glossy and matte finish films were measured. A "Haze-Gard Plus" instrument commercially available from BYK-Gardner of Columbia, Md. was used to measure clarity and haze, and a "Micro-Gloss" instrument, also from BYK-Gardner, was used to measure 60 degree gloss as a function of cylinder pressure and as a function of linear load. The clarity of the coated films of the comparatives was nearly 100%. FIGS. 10, 11 and 12 are plots of film clarity, haze and 60 degree gloss—each as a function of the pneumatic cylinder pressure of the nip. Optical properties were adjusted for coatings at a constant average film thickness by adjusting the linear load of the nip rollers.

Example 3

A system similar to that shown in FIG. 1, was arranged on a HIRANO MULTI COATER™ Model M-200 coating machine, commercially available from Hirano Tecseed Company, Ltd. of Nara, JP. A coating die of the type discussed in co-assigned U.S. Pat. No. 5,639,305 was used to deposit a 4 inch (10.16 cm) wide layer of a coatable material at various thicknesses, onto a 9 inch (22.86 cm) wide, 5 mil (0.127 mm) thick substrate of commercially available pre-primed polyethylene terephthalate (PET) film obtained from DuPont Teijen Films U.S. under the trade designation MELINEX 618. The coatable material was based on the PETA material as described in Example 1. A conventional pump fed the coatable material to the die. Additional amounts of hexanediol diacrylate monomer were added to the coatable material with the goal of altering (e.g., lowering) the viscosity of the coatable material that exited the thickening station.

The coated substrate was conveyed into a convection oven operated at 158° F. (70° C.) with a fan speed set to provide a forced air velocity of 18 ft/sec (5.49 m/s) to increase the viscosity of the coatable material to provide a coated substrate having a higher viscosity coatable material thereon. The higher viscosity coatable material was directed to a station where it was treated with face-side roller contacts. A variety of face-side and backing rollers with nitrile rubber elastomer covers of different Shore-A durometer were utilized. A rigid roller made of aluminum was also used as a backing roller. The face-side roller was brought into contact with the coatable material of the coated substrate using a pneumatic actuator as the coated substrate was nipped between the face-side roller and a backing roller. The air pressure in the actuator was used to control the intensity of the load against the backing roll. Upon exiting the station, it was observed that the clear and glossy appearance of the coatable material was changed to a matte finish. The coated film with a matte finish was cured with a UV illumination system commercially available from Fusion UV Systems, Inc., Gaithersburg, Md. utilizing a mercury source (H bulb).

Figure 13:
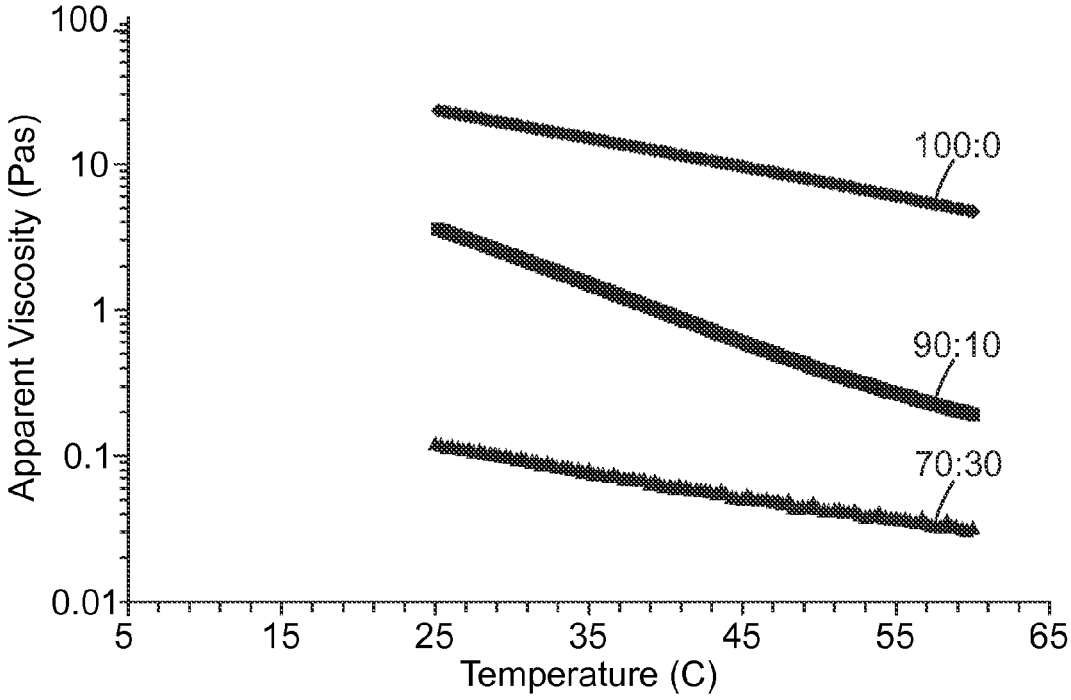
FIG. 13 is a plot of apparent viscosity at a shear rate of 20 $sec^{-1}$ as a function of temperature for coatable materials blended as described in Example 3.

Increases in the concentration of hexanediol diacrylate (HDDA) monomer used in the formulation of the coatable material tended to lower the apparent viscosity of the coatable material. Films were produced at different line speeds from blends of coatable materials comprising 70:30 (PETA:HDDA), 90:10 (PETA:HDDA) and 100:0 (PETA). The line speed for the films resulting from 70:30 (PETA:HDDA) and 90:10 (PETA:HDDA) was 100 feet per minute (30.5 meters per minute). The line speed for the films resulting from the 100:0 (PETA) composition was 10 feet per minute (3.05 meters per minute). Films resulting from the coatable material blends having 10% HDDA were lower in apparent viscosity than compositions formulated (e.g., as in Example 1) without added HDDA. Compositions formulated with up to 30% added HDDA were lower still in their apparent viscosity. Apparent viscosity measurements were made for these compositions as a function of temperature, and the data are set forth in the graph of FIG. 13.

Comparatives were prepared in the same manner as described in Example 1, having a glossy PETA coated layer with a thickness of 2 and 4 microns on top of the substrate. Thicknesses for the coated layers in the inventive samples were 2 and 4 microns on top of the substrate.

Figure 14:
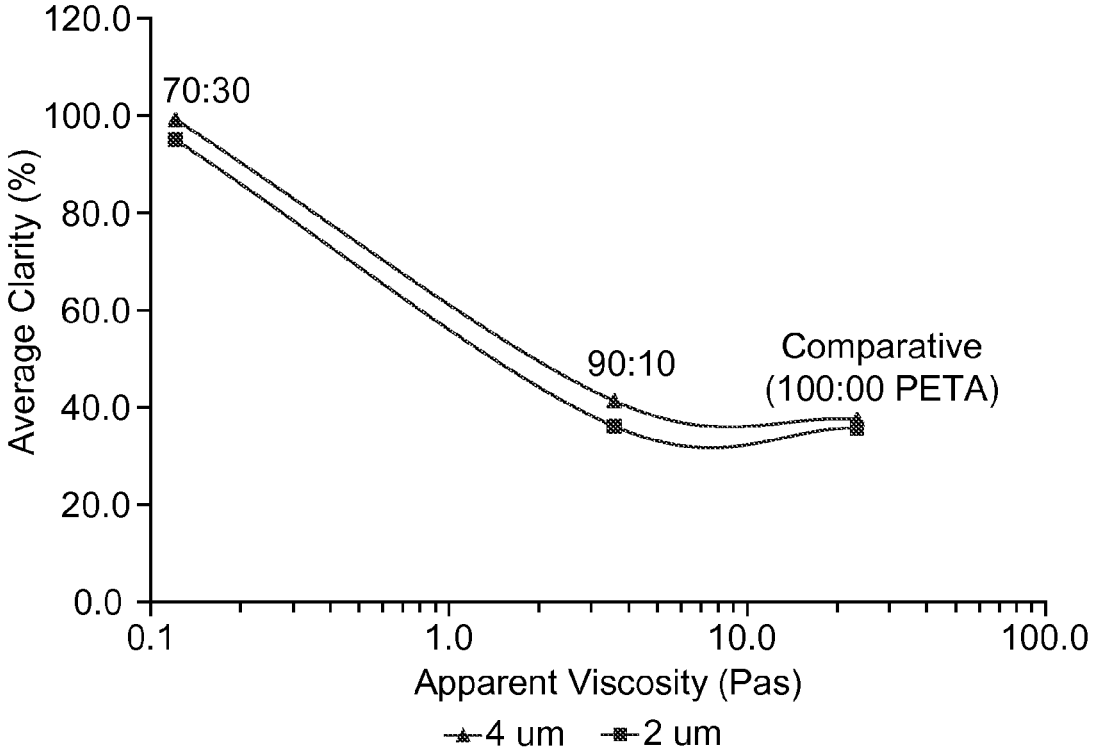
FIG. 14 is a plot of average clarity as a function of apparent viscosity for films described in Example 3.
Figure 15:
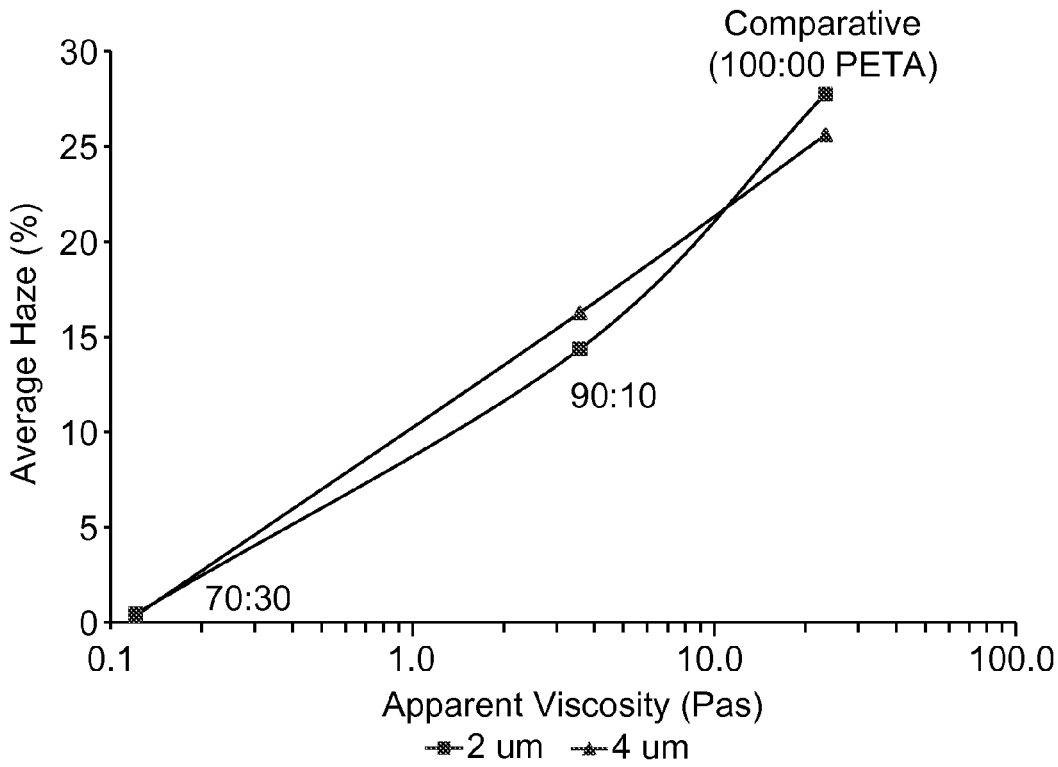
FIG. 15 is a plot of average haze as a function of apparent viscosity for films described in Example 3.
Figure 16:
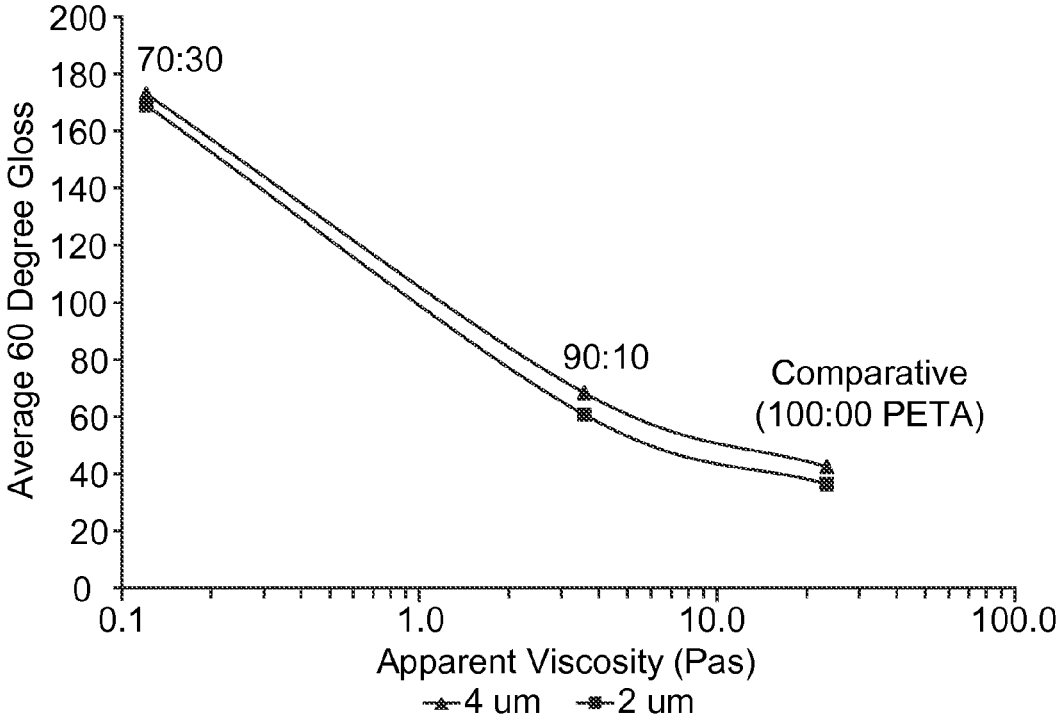
FIG. 16 is a plot of average 60 degree gloss as a function of apparent viscosity for films described in Example 3.

Optical properties of the glossy PETA comparatives and the inventive matte finish films were measured. A "Haze-Gard Plus" instrument commercially available from BYK-Gardner of Columbia, Md. was used to measure clarity and haze, and a "Micro-Gloss" instrument, also from BYK-Gardner, was used to measure 60 degree gloss. Plots of the data are shown in FIGS. 14-16 for the films resulting from the 70:30, 90:10 and 100:0 blends.

Example 4

Coatable materials were prepared as coatable solutions of polymerizable materials having a solids content from 30 to 47 wt. %, each of the coatable materials including 1.5% by weight of a UV photoinitiator obtained commercially from Ciba Specialty Chemicals of Basil, Switzerland under the trade designation "Darocur 1173." None of the coatable materials included any added particulate (e.g., nanoparticles). The coatable materials were as follows:

(A) A solution of 33% aliphatic urethane acrylate oligomer, obtained commercially under the trade designation "Photomer 6010," from Cognis North America of Cincinnati, Ohio in a 2-butanone diluent.

(B) A solution of 28.9% aliphatic polyester based urethane diacrylate oligomer, obtained commercially under the trade designation "CN964," from Sartomer Company, Inc. of Exton, Pa. in a 2-butanone diluent.

(C) A solution of 41.4% aliphatic urethane acrylate oligomer, obtained commercially under the trade designation "Photomer 6010," and 10% by weight 1,6-hexanediol diacrylate monomer, obtained commercially under the trade designation "SR-238," from Sartomer Company, Inc. of Exton, Pa. in a 2-butanone diluent.

(D) A solution of 47.3% aliphatic polyester based urethane diacrylate oligomer, obtained commercially under the trade designation "CN964," and 10% by weight 1,6-hexanediol diacrylate monomer, obtained commercially under the trade designation "SR-238," in a 2-butanone diluent.

(E) PETA—formulated as in Example 1.

Figure 17:
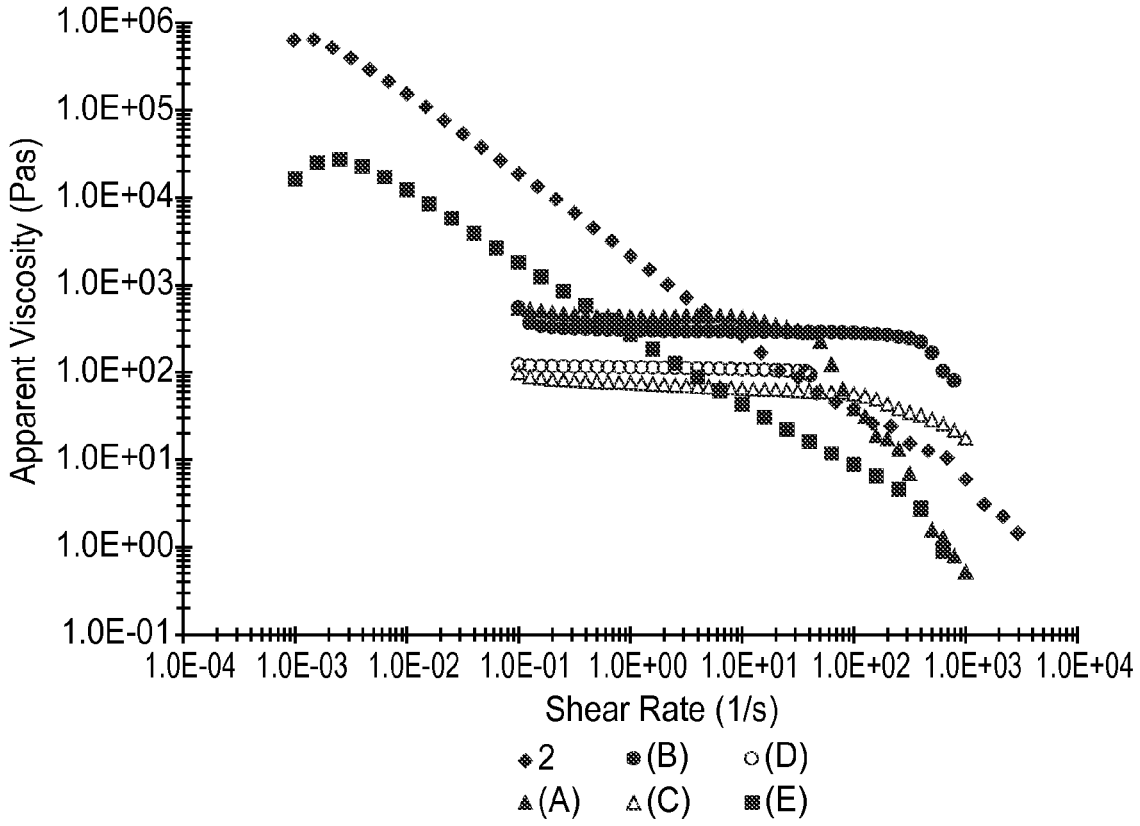
FIG. 17 is a plot of the apparent viscosity as a function of shear rate for the coatable materials of Example 3 and Example 4.

Apparent viscosity measurements were made for these coatable materials as a function of shear rate, and the data are set forth in the graph of FIG. 17. Additionally, the coatable material of Example 3 was also measured. All of these measurements were obtained prior to increasing the viscosity of the coatable materials and prior to face-side roller treatment of the resulting surfaces.

Articles having matte finishes were prepared with coatable materials (A)-(E). A system similar to that shown in FIG. 1, was arranged on a HIRANO MULTI COATER™ Model M-200 coating machine, commercially available from Hirano Tecseed Company, Ltd. of Nara, JP. A coating die of the type described in U.S. Pat. No. 5,639,305 was used to deposit a 4 inch (10.16 cm) wide layer of a coatable material at various thicknesses, onto a 9 inch (22.86 cm) wide, 5 mil (0.127 mm)

thick commercially available pre-primed polyethylene terephthalate (PET) film obtained from DuPont Teijen Films U.S. under the trade designation MELINEX 618. A conventional pump fed the coatable material to the die. The coated substrate was conveyed into a convection oven operated at 158° F. (70° C.) with a fan speed set to provide a forced air velocity of 18 ft/sec (5.49 m/s) to increase the viscosity of the coatable material and provide a coated substrate with a higher viscosity coated layer. The coated substrate was then conveyed to a station having three face-side rollers arranged as in Configuration C of Example 1, each face-side roller having a nitrile rubber elastomer cover. An elastomer covered backing roller was used to nip the coated substrate against the third or last of the three face side rollers. The coated substrate was next directed into another station equipped with a UV source (H bulb) (obtained from Fusion UV Systems, Inc., Gaithersburg, Md.), and the coatable material was UV cured to provide a thickness of 2 microns on top of the substrate for all of the inventive articles as well as the glossy comparatives. Line speeds were varied. The line speeds for films made from solutions (A), (B) and (D) were 20 ft per minute (6.1 meters per minute). The line speed for films made from solution (C) was 15 ft per minute (4.6 meters per minute). The line speed for films made from solution (E) was 10 ft per minute (3.05 meters per minute).

A comparative article was also prepared using the 100:0 PETA coatable material (E) without subjecting the coated substrate to treatment by face-side rollers. As a result, the comparative article had a glossy finish while all of the inventive articles had a matte finish.

Figure 18:
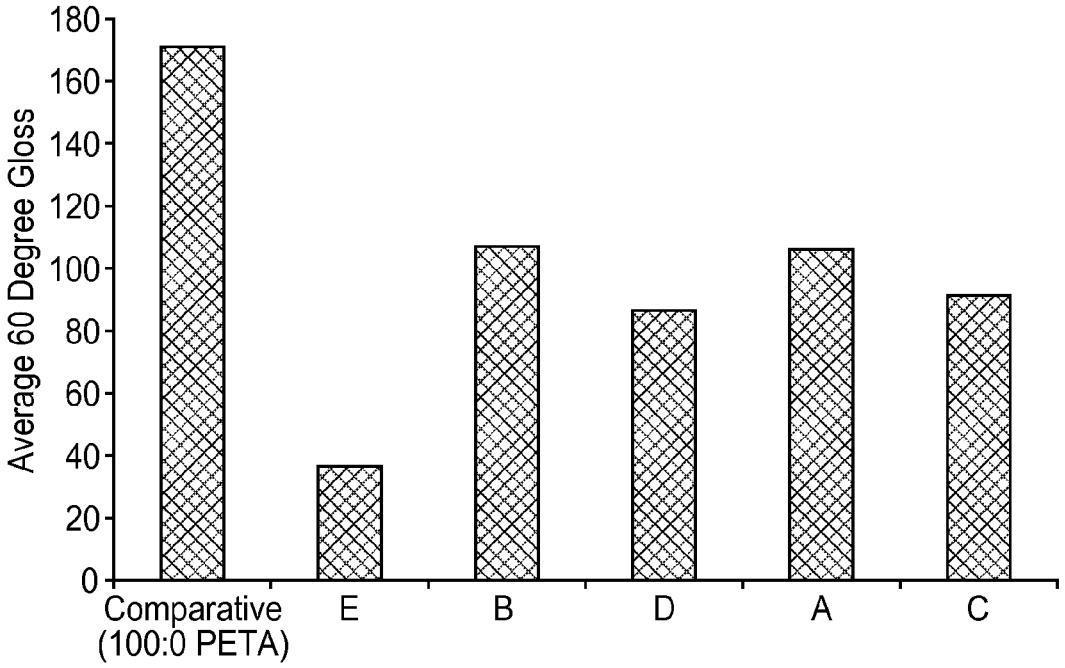
FIG. 18 is a bar chart comparing the average 60 degree gloss of films made in Example 4.
Figure 19:
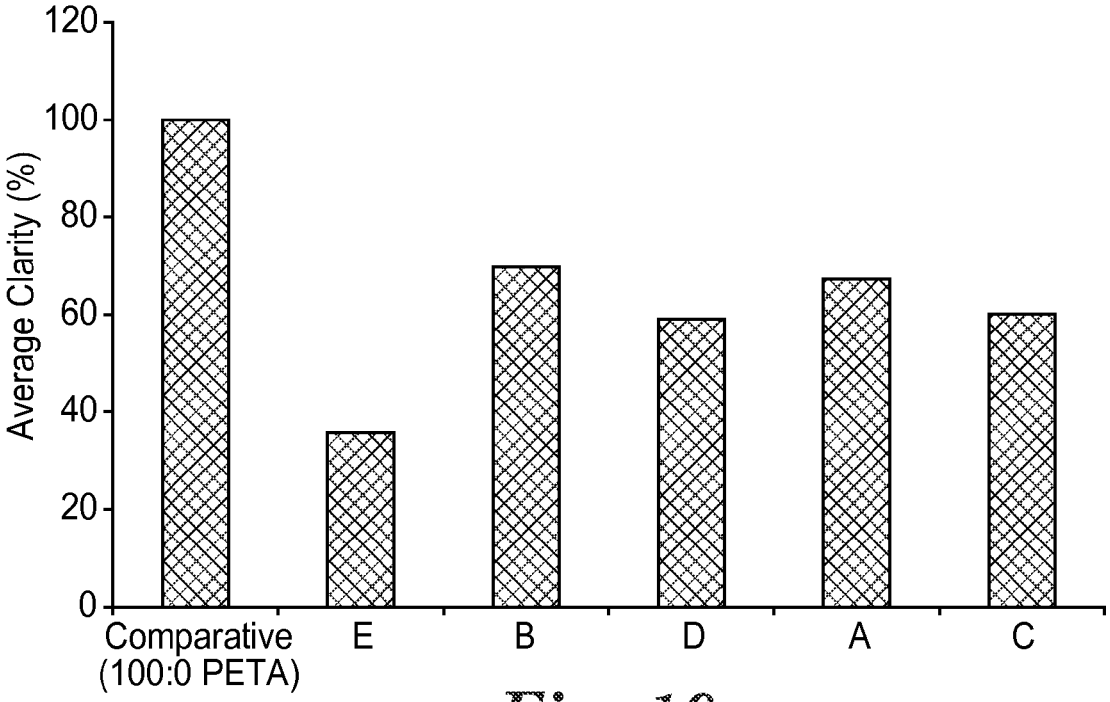
FIG. 19 is a bar chart comparing the average clarity of films made in Example 4.
Figure 20:
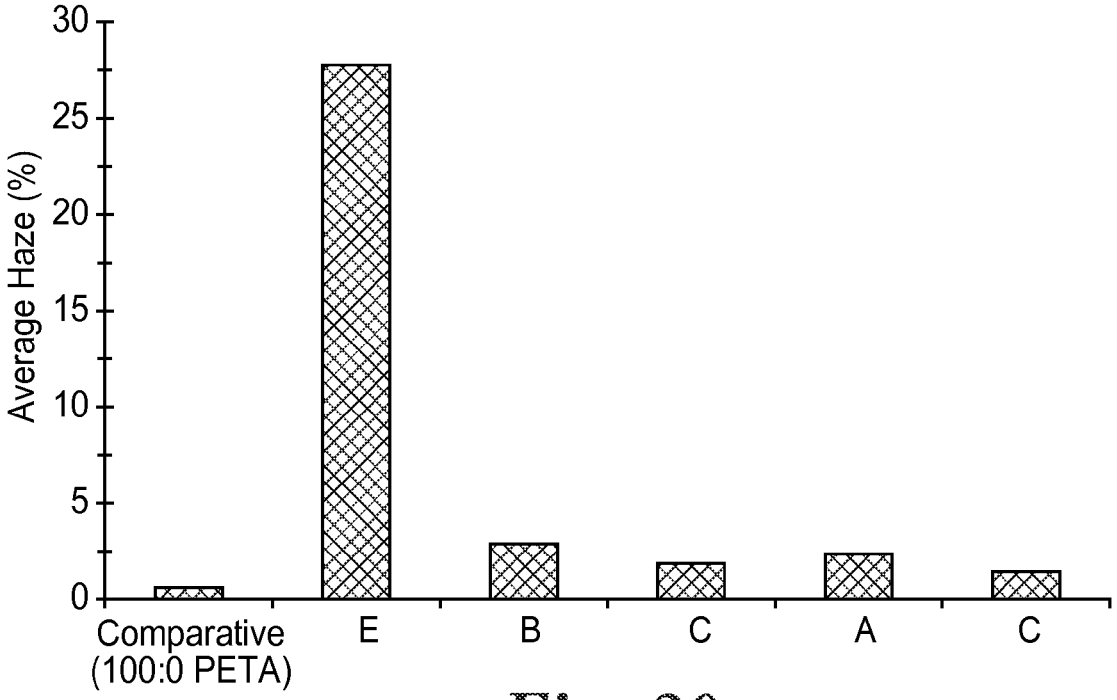
FIG. 20 is a bar chart comparing the average haze of films made in Example 4.

Properties of the comparative article (having a glossy finish) and of the inventive articles (having a matte finish) were measured. A "Haze-Gard Plus" instrument commercially available from BYK-Gardner of (Columbia, Md. was used to measure clarity and haze. A "Micro-Gloss" instrument, also from BYK-Gardner, was used to measure 60 degree gloss. The measurements are graphically depicted in FIGS. 18-20.

The invention has been shown and described with reference to various embodiments. It will be understood by those skilled in the art that changes and modifications may be made to the described embodiments without departing from the spirit and scope of the invention.

What is claimed:

1. A system for providing a film having a matte finish, the system comprising:

Means for providing a coated substrate, the coated substrate comprising a first coatable material applied to a substrate, the coatable material forming a first major surface of the coated substrate, wherein the coatable material has a first major surface in contact with the substrate and a second major surface opposite the first major surface of the coatable material;

Means for changing the viscosity of the first coatable material from a first viscosity to a second viscosity;

At least one face-side roller having an outer surface positioned to contact the first major surface of the coated substrate to impart a matte finish thereon, wherein the outer surface of the at least one face-side roller is featureless or includes a pattern that can be imparted onto the second major surface of the first coatable material; and Optionally, means for hardening the first coatable material.

2. The system of claim 1 wherein means for providing a coated substrate comprises a source of a pre-coated substrate.

3. The system of claim 1 wherein means for providing a coated substrate comprises a first means for applying a first coatable material having a first viscosity to the substrate, the first coatable material forming the first major surface of the coated substrate.

4. The system of claim 1 wherein the first means for applying a coatable material comprises a first station.

5. The system of claim 4 wherein the first station comprises an extrusion die for coating the coatable material onto the substrate.

6. The system of claim 4 wherein the first station comprises a station for coating the coatable material using a coating process selected from the group consisting of slide coating, curtain coating, immersion coating, roll coating, gravure coating, fluid bearing coating and spray coating.

7. The system of claim 1 wherein the substrate comprises one or more optically clear material(s) selected from the group consisting of optically clear polyester film, triacetate film, polyethylene naphthalate, biaxially-oriented polypropylene, simultaneously biaxially-oriented polypropylene, polycarbonate and combinations of two or more of the foregoing.

8. The system of claim 1 wherein the means for changing the viscosity of the first coatable material is a means for increasing the viscosity of the first coatable material.

9. The system of claim 8 wherein the first means for increasing the viscosity of the first coatable material is an oven.

10. The system of claim 8 wherein the first means for increasing the viscosity of the first coatable material is a source of electromagnetic radiation selected from sources of ultraviolet radiation, infrared radiation, x-rays, gamma-rays, visible light and combinations of two or more of the foregoing.

11. The system of claim 8 wherein the means for increasing in the viscosity of the first coatable material is an electron beam source.

12. The system of claim 1 further comprising more than one face-side roller, each face-side roller positioned to contact the first major surface of the coated substrate to impart a matte finish thereon.

13. The system of claim 12 wherein the system comprises three face-side rollers.

14. The system of claim 13 wherein each of the three face-side rollers have different cross-sectional diameters.

15. The system of claim 12 wherein the system comprises six face-side rollers.

16. The system of claim 15 wherein the each of the six face-side rollers have different cross-sectional diameters.

17. The system of claim 1 further comprising a backing roller, the face-side roller and the backing roller being configured in a nip arrangement wherein the face-side roller is positioned to contact the second surface of the first coatable material while the substrate is carried on the backing roller, the backing roller being moveable with respect to the face-side roller under the operation of an actuator associated with the backing roller.

18. The system of claim 1 wherein the outer surface of the at least one face-side roller is featureless.

19. The system of claim 1 wherein the outer surface of the at least one face-side roller includes a pattern that can be imparted onto the second major surface of the first coatable material.

20. The system of claim 1 wherein the means for hardening the first coatable material comprises a heat source.

21. The system of claim 1 wherein the means for hardening the first coatable material comprises a source of electromagnetic radiation.

22. The system of claim 21 wherein the source of electromagnetic radiation is selected from sources of ultraviolet radiation, infrared radiation, x-rays, gamma-rays, visible light and combinations of two or more of the foregoing.

23. The system of claim 1 wherein the means for hardening the first coatable material comprises an electron beam source.

24. The system of claim 1 wherein the system includes means for hardening the first coatable material comprises a means for heating the face-side rollers.

25. The system of claim 1, wherein the coatable material is a film forming material.

26. The system of claim 1, wherein the coatable material comprises a polymerizable material.

27. The system of claim 26, wherein the coatable material comprises a dispersion comprising oligomer, polymer and monomer in a solvent.

28. The system of claim 26, wherein the coatable material further comprises particles having an average particle size distribution, ranging from about 0.05 micron to about 60 microns.

29. The system of claim 28, wherein the particles comprise surface-modified particles.

30. The system of claim 26, wherein the coatable material further comprises surface-modified nanoparticles.

31. The system of claim 30, wherein the nanoparticles comprise particles of oxides selected from the group consisting of aluminum oxide, tin oxide, antimony oxide, silicon oxide, zirconium oxide, titanium oxide, and combinations of two or more of the forgoing.

32. The system of claim 30 wherein the nanoparticles are surface modified with a surface treatment agent selected from the group consisting of alcohols, amines, carboxylic acids, sulfonic acids, phosphonic acids, silanes, titanates and combinations of two or more of the foregoing.

33. The system of claim 30, wherein the nanoparticles are surface modified with a surface treatment agent selected from the group consisting of isooctyl trimethoxysilane, N-(3-triethoxysilylpropyl)methoxyethoxyethoxyethyl carbamate, N-(3-triethoxysilylpropyl) methoxyethoxyethoxyethyl carbamate, 3-(methacryloyloxy)propyltrimethoxysilane, 3-acryloxypropyltrimethoxysilane, 3-(methacryloyloxy)propyltriethoxysilane, 3-(methacryloyloxy) propylmethyldimethoxysilane, 3-(acryloyloxypropyl)methyldimethoxysilane, 3-(methacryloyloxy)propyldimethylethoxysilane, 3-(methacryloyloxy) propyldimethylethoxysilane, vinyldimethylethoxysilane, phenyltrimethoxysilane, n-octyltrimethoxysilane, dodecyltrimethoxysilane, octadecyltrimethoxysilane, propyltrimethoxysilane, hexyltrimethoxysilane, vinylmethyldiacetoxysilane, vinylmethyldiethoxysilane, vinyltriacetoxysilane, vinyltriethoxysilane, vinyltriisopropoxysilane, vinyltrimethoxysilane, vinyltriphenoxysilane, vinyltri-t-butoxysilane, vinyltrisisobutoxysilane, vinyltriisopropenoxysilane, vinyltris(2-methoxyethoxy)silane, styrylethyltrimethoxysilane, mercaptopropyltrimethoxysilane, 3-glycidoxypropyltrimethoxysilane, acrylic acid, methacrylic acid, oleic acid, stearic acid, dodecanoic acid, 2-[2-(2-methoxyethoxy) ethoxy]acetic acid, beta-carboxyethylacrylate, 2-(2-methoxyethoxy)acetic acid, methoxyphenyl acetic acid and mixtures of two or more of the foregoing.

34. The system of claim 30, wherein the nanoparticles comprise an average particle size within the range from about 1 nm to about 100 nm.

35. The system of claim 1 further comprising:

Means for applying a layer of a second coatable material having an initial viscosity to the first major surface of the coated substrate.

36. The system of claim 1 further comprising:

Means for applying a second layer of a coatable material having an initial viscosity to the first major surface of the coated substrate;

Means for changing the viscosity of the second layer of coatable material from an initial viscosity to a second viscosity;

A face-side roller having an outer surface positioned to contact the second layer of coatable material to impart a matte finish thereon; and Optionally, second means for hardening the second layer of coatable material.

37. The system of claim 1 wherein the substrate comprises material selected from the group consisting of woven materials, knitted materials, polymer films, nonwoven materials, metallic sheets, metallic foil, glass and combinations of two or more of the foregoing.

38. The system of claim 1, wherein the coatable material is of sufficient tack that a portion of the coatable material adheres to the surface of the at least one face-side roller.

39. A system for providing a film having a matte finish, the system comprising:

means for providing a coated substrate, the coated substrate comprising a first coatable material applied to a substrate, the coatable material forming a first major surface of the coated substrate;

means for changing the viscosity of the first coatable material from a first viscosity to a second viscosity;

at least one face-side roller having an outer surface positioned to contact the first major surface of the coated substrate to impart a matte finish thereon;

at least one backing roller, the at least one face-side roller and the at least one backing roller being configured in a nip arrangement wherein the at least one face-side roller is positioned to contact the second surface of the first coatable material while the substrate is carried on the at least one backing roller, the at least one backing roller being moveable with respect to the at least one face-side roller under the operation of an actuator associated with the at least one backing roller; and optionally, means for hardening the first coatable material.

40. The system of claim 39 wherein the outer surface of the at least one face-side roller is featureless.

41. The system of claim 39 wherein the outer surface of the at least one face-side roller includes a pattern that can be imparted onto the second major surface of the first coatable material.

* * * * *